US008911338B2

(12) United States Patent
Ishizuka

(10) Patent No.: US 8,911,338 B2
(45) Date of Patent: Dec. 16, 2014

(54) FOLDER GLUER

(75) Inventor: Mitsuhiro Ishizuka, Kasugai (JP)

(73) Assignee: Kabushiki Kaisha Isowa, Aichi (JP)

( * ) Notice: Subject to any disclaimer, the term of this patent is extended or adjusted under 35 U.S.C. 154(b) by 871 days.

(21) Appl. No.: 12/688,624

(22) Filed: Jan. 15, 2010

(65) Prior Publication Data

US 2010/0190627 A1 Jul. 29, 2010

(30) Foreign Application Priority Data

Jan. 23, 2009 (JP) ..... 2009-013692

(51) Int. Cl.
*B31B 1/00* (2006.01)

(52) U.S. Cl.
USPC ..... 493/32; 493/453

(58) Field of Classification Search
USPC ..... 493/32, 10, 421, 177, 453
See application file for complete search history.

(56) References Cited

U.S. PATENT DOCUMENTS

| | | | | |
|---|---|---|---|---|
| 3,901,134 | A * | 8/1975 | Reizenstein et al. | 493/10 |
| 4,119,018 | A * | 10/1978 | Nava | 493/10 |
| 4,432,745 | A * | 2/1984 | Eldridge | 493/10 |
| 4,604,083 | A * | 8/1986 | Barny et al. | 493/34 |
| 6,129,503 | A | 10/2000 | Schenone | |
| 7,708,679 | B2 | 5/2010 | Cailloux et al. | |
| 2004/0245071 | A1 * | 12/2004 | Giffin | 198/460.1 |
| 2006/0063655 | A1 * | 3/2006 | Baenninger et al. | 493/10 |
| 2008/0171644 | A1 | 7/2008 | Cailloux et al. | |

FOREIGN PATENT DOCUMENTS

| | | | |
|---|---|---|---|
| CN | 1261319 | A | 7/2000 |
| CN | 101224643 | A | 7/2008 |
| JP | 2007-185799 | | 7/2007 |

OTHER PUBLICATIONS

Partial English translation of Chinese Office Action issued on Nov. 29, 2012 in Application No. 201010001049.0.

* cited by examiner

*Primary Examiner* — Sameh H. Tawfik
(74) *Attorney, Agent, or Firm* — Stroock & Stroock & Lavan LLP

(57) ABSTRACT

A folder gluer for folding a cardboard sheet having first through fourth panels connected through connecting portions and a glue tab and joining the first and fourth panels at the glue tab is disclosed. The folder gluer includes a pair of pressing members movable relative to one another in a cardboard sheet width direction perpendicular to a cardboard sheet feed direction for pressing the connecting portions of the first and fourth panels which are being folded, a detector disposed upstream in the feed direction from the pair of pressing members for detecting a passage of the cardboard sheet being fed in the feed direction and generating a detection signal, and a controller for determining, based on the generation of the detection signal from the detector, a timing at which the pair of pressing members are caused to move relative to one another and press on the connection portions of the first and fourth panels after the first and fourth panels are folded to 90° and before being folded to 180°.

5 Claims, 19 Drawing Sheets

FOLDER GLUER

BACKGROUND OF THE INVENTION

1. Field of the Invention

The present invention relates to a folder gluer, and more particularly to a folder gluer for folding and joining a cardboard sheet having four panels and a glue tab.

2. Description of the Related Art

In general, cardboard sheet box-forming machines perform slotting and creasing; slots and creases are formed on cardboard sheets extending in the feed direction. Cardboard sheets for forming a box have four panels and a glue tab. A folder gluer is one processing device within a cardboard box making machine, by which two panels in a cardboard sheet are folded 180° and that folded single panel is glued to a glue tab. Two panels are folded by being brought into contact with a folding bar or a folding belt as a cardboard sheet is fed at high speed. During this folding, the two panels spread apart on the upstream side in the feed direction due to contact friction resistance with the folding belt or the like, splaying in fishtail form so that their folding direction skews away from the creases formed on the cardboard sheet.

In order to correct for the above fishtail-splaying folded portion after the fact, the conventional folder gluer disclosed in JP-2007-185799A is furnished with a pair of pressing plates movable in the width direction of the sheet, perpendicular to the feed direction. The pair of pressing plates press the splayed folded portions in the sheet width direction. A sensor is placed upstream of the pair of pressing plates in the feed direction, and detects the passing of the front edge of the cardboard sheet. After the elapse of a predetermined time following detection of passage of the front edge of the cardboard sheet by the sensor, the pair of pressing plates move in the sheet width direction and apply an instantaneous strong pressure to the outside edge of the folded portions. In the folder gluer of JP-2007-185799A described above, the instantaneous pressing operation by the pair of pressing plates is carried out after the two panels on each side of the cardboard sheet are folded to 180° and before the two panels are glued on the glue tab.

SUMMARY OF THE INVENTION

The folder gluer set forth in the above-described JP-2007-185788A corrects fishtail-shaped splaying after it has already occurred, and the timing at which the pair of pressing plates are pressed occurs after the two panels on each side of the cardboard sheet have been folded to 180°. When thus folded by 180°, the direction of formation of a crease extending in the feed direction of the cardboard sheet is established; the outer edge portion of the 180° folded portion is in a highly rigid state, unprone to deformation. Therefore even if the outside edge portions are pressed with a strong pressure force by the pair of pressing plates in the aforementioned highly rigid state, the position of the crease at the fishtail-splayed folded portion is already established, making it difficult to correct the crease formation position accurately. In a folder gluer, the cardboard sheet panel is generally sequentially folded starting from the edge portion of the sheet and continuing as the sheet is fed; the direction in which that crease is formed gradually departs from the position at which the line is drawn due to contact friction resistance with the folding belt and the like. Where the rigid outside edge portions, folded to 180°, are pressed, as in the folder gluer set forth in the above-described JP-2007-185788A, it not possible as a measure against skewing in the fold-forming direction occurring at the edge portion of the cardboard sheet to accurately correct the crease forming position once it has been established, although attempts to do so, and correction faults occur. Such correction faults become more pronounced as the cardboard sheet lengthens in the feed direction.

It is therefore an object of the present invention to provide a folder gluer capable of accurately correcting the position at which creases are formed at the connecting portions of cardboard sheet panels, thereby preventing the occurrence of fishtail splaying.

The above object is achieved according to the first aspect of the present invention by providing a folder gluer for folding a cardboard sheet having first through fourth panels connected through connecting portions and a glue tab and joining the first and fourth panels at the glue tab, the folder gluer comprising a pair of pressing members movable relative to one another in a cardboard sheet width direction perpendicular to a cardboard sheet feed direction for pressing the connecting portions of the first and fourth panels which are being folded, a detector disposed upstream in the feed direction from the pair of pressing members for detecting a passage of the cardboard sheet being fed in the feed direction and generating a detection signal, and a controller for determining, based on the generation of the detection signal from the detector, a timing at which the pair of pressing members are caused to move relative to one another and press on the connection portions of the first and fourth panels after the first and fourth panels are folded to 90° and before being folded to 180°.

According to the present invention described above, the controller determines, based on the generation of the detection signal from the detector, a timing at which the pair of pressing members are caused to move relative to one another and press on the connection portions of the first and fourth panels after the first and fourth panels are folded to 90° and before being folded to 180°. As a result, in the present invention, the direction of crease formation can be accurately corrected to a desired position, and a fishtail-shaped splaying can be prevented before it occurs, because the connecting portions are pressed when the crease formation direction in the connecting portions are not yet established and the connecting portions are not yet in a highly rigid state.

In a preferred embodiment of the present invention, the pair of pressing members approach one another and separate from one another in the cardboard sheet width direction to press the connecting portions of the first and fourth panels, and a distance between the pair of pressing members when the pair of pressing members approach one another is set to be smaller than a predetermined folding width interval in the cardboard sheet width direction between the first panel connecting portion and the fourth panel connecting portion when the first and fourth panels are in a 180° folded state.

Prior to folding the cardboard sheet first and fourth panels to 180°, the crease formation direction splays outward when the pressure forces are removed, due to the elasticity of the connecting portions, which is still not in a rigid state, even if the pair of pressing members push the first and fourth panel connecting portions to a predetermined folding width interval. Therefore, according to the preferred embodiment of the present invention described above, the pair of pressing members press the connecting portions to a distance smaller than the predetermined folding width interval, and the crease formation direction is corrected when the elasticity of the connecting portions have become small, so there is no change in the corrected crease formation direction even after the pressure forces are removed, and the direction of crease formation at the connecting portions can be accurately corrected.

In another preferred embodiment of the present invention, the controller determines a timing at which the pair of pressing members approach one another and a timing at which the pair of pressing members separate from one another, and holds the pressing members in a proximate state during the period from the approach timing to the separation timing, and the controller determines, as the approach timing, based on the generation of the detection signal from the detector, the timing for causing the pair of pressing members to approach one another and press the first and fourth panel connecting portions after the first and fourth panels are folded by 90° and before being folded by 180° and determines the separation timing according to the length of the area in the feed direction of the connecting portion being pressed.

If the time from the approach timing until the separation timing is fixed, without reference to the length of the area in the feed direction in which the connecting portions are being pressed, or is instantaneous as in the conventional art, the connecting portions are only pressed in a localized manner, and over a wide range there will be no correction of the forming directions of the creases which have gradually formed from the front edge sides of the connecting portions. Therefore, according to the preferred embodiment of the present invention, the crease formation directions are accurately corrected over a wide range of the connecting portions by determining separation timing according to the length of the area of the connecting portions in the feed direction.

In another embodiment of the present invention, the difference between the pair of pressing members in the proximate state is equal to or larger than ½ of one flute pitch and equal to or smaller than one flute pitch of a corrugated medium of the cardboard sheet being folded.

According to the preferred embodiment of the present invention described above, the total amount pressed by the pair of pressing members is set to be equal to or larger than ½ of one flute pitch and equal to or smaller than one flute pitch of a corrugated medium of the cardboard sheet, therefore the difference between the connecting portion interval when the crease formation position is splayed in a fishtail shape and the predetermined folding width interval is equal to or larger than ½ of one flute pitch and equal to or smaller than one flute pitch, and the crease forming direction can be accurately corrected.

In another preferred embodiment of the present invention, the folder gluer further comprises a distance changing device for changing the distance between the pair of pressing members in the proximate state in accordance with a cardboard sheet flute type.

According to the preferred embodiment of the present invention, the interval changing portion changes the interval in accordance with the flute type when the pair of pressing members are in the proximate state. As a result, in the preferred embodiment of the present invention, the interval when the pair of pressing members are in the proximate state is automatically changed and the connecting portion crease forming directions are accurately corrected even if the cardboard sheet flute types differ.

In another preferred embodiment of the present invention, the controller determines, based on the generation of the detection signal from the detector, the timing for causing the pair of pressing members to move relative to one another and press the connecting portions of the first and fourth panels, when the first and fourth panels of the cardboard sheet creased on one surface are folded at the connecting portions, and after being folded to the state in which the first and fourth panels respectively begin to make contact with the second and third panels on the one surface of the connecting portions, but before being folded 180°.

According to the preferred embodiment of the present invention, because the connecting portions are pressed in a state that the first and fourth panels are beginning to make contact with the second and third panels on one surface of the connecting portions and the corrugated medium is buckling so that the positions of crease formations are determined, the crease formation positions in the connecting portions are changed according to the movement of each of the pressing members and thus are accurately corrected.

In another preferred embodiment of the present invention, the cardboard sheet comprises slot forming portions at one end only for forming slots (S1 through S3) extending in a direction parallel to the feed direction, and connecting portions from the terminuses of the slots to the other end of the cardboard sheet, and the controller determines the separation timing in accordance with the predetermined connecting portion dimension in the feed direction from the terminus of the slots to the other end of the cardboard sheet.

With respect to a cardboard sheet on which slots are formed at one end only, i.e. a single flap cardboard sheet, the connecting portion predetermined dimension from the terminus of the slots to the other end of the cardboard sheet is the dimension of the depth of the box formed by the cardboard sheet. In general, the dimension in the feed direction of connecting portions for which there is a risk of fishtail splaying corresponds to the box depth dimension. Therefore, according to the preferred embodiment of the present invention, the separation timing at which the pair of pressing members complete the pressing operation is determined according to the predetermined connecting portion dimension from the slot terminus to the other end, and the range over which the connecting portions are to be corrected can be accurately determined.

The above object is also achieved according to the second aspect of the present invention by providing a folder gluer for folding a cardboard sheet having first through fourth panels connected through connecting portions and a glue tab and joining the first and fourth panels at the glue tab, the folder gluer comprising a pair of guide/limit members disposed in a predetermined guide interval in a cardboard sheet width direction perpendicular to a cardboard sheet feed direction for guiding and limiting the first and fourth panel connecting portions as being folded, a pair of pressing members movable so as to approach one another and separate from one another in the cardboard sheet width direction for pressing the connecting portions of the first and fourth panels which are being folded, the pair of pressing members being set so that an interval in a proximate state is smaller than a predetermined guide interval for the pair of guide/limit members, a detector disposed upstream in the feed direction from the pair of pressing members for detecting a passage of the cardboard sheet being fed in the feed direction and generating a detection signal, and a controller for determining an approach timing for causing the pair of press members to approach one another and press the connecting portions of the first and fourth panels based on the generation of the detection signal from the detector, and determining a separation timing for causing the pair of pressing members to separate from one another according the length of the area in the feed direction of the connecting portions being pressed, and for holding the pair of pressing members in the proximate state during the period from the approach timing to the separation timing, after the first and fourth panels are folded to 90° and before being folded 180°.

According to the present invention described above, the pair of pressing members are movable so as to approach one another and separate from one another, and the interval in the proximate state of the pair of pressing members is smaller than the predetermined guide interval for the pair of guide/limit members. The approach timing is determined based on the generation of the detection signal after the first and fourth panels have been folded by 90° but before being folded by 180°, and the pair of pressing members are held in the proximate state during the period from the approach timing to the separation timing. As a result, in the present invention, the pair of pressing members press the respective connecting portions to the interval which is smaller than the predetermined guide interval, after the first and fourth panels have been folded 90° and before being folded 180°, therefore the crease formation position is corrected in a state that the crease formation positions are not established in the connecting portions and, although the connecting portions have low elasticity, the connecting portions are not in a high rigidity state, so the corrected crease formation directions do not change even after the pressing forces are removed. Additionally, the crease formation directions are accurately corrected over a wide range of the connecting portions because the separation timing is determined according to the length in the feed direction of the area in which the connecting portions are pressed.

In a preferred embodiment of the present invention, the predetermined guide interval for the pair of guide/limit members is set to be the same as the predetermined folding width interval in the cardboard sheet width direction between the first panel connecting portion and the fourth panel connecting portion when the first and fourth panels are folded to 180°, and the distance between the pair of pressing members in the proximate state is set to be smaller than the predetermined folding width interval.

According the preferred embodiment of the present invention, the predetermined guide interval for the pair of guide/limit member is set to be the same as the predetermined folding width interval, and the interval when the pair of pressing members are in the proximate state is set to be smaller than the predetermined width interval. In general, the initial folding interval in the cardboard sheet width direction between the first panel connecting portion and the fourth panel connecting portion when the first and fourth panels are folded by 90° is larger than the final folding interval in the cardboard sheet width direction between the first panel connecting portion and the fourth panel connecting portion when the first and fourth panels are folded by 180°. Because the predetermined folding width interval is the natural length of a cardboard sheet in which panels are folded to 180°, changing the crease formation positions of a cardboard sheet folded to the 180° requires that the cardboard sheet connecting portions be pressed to a correction interval smaller than the predetermined folding width interval. Therefore in preferred embodiment of the present invention, the pair of guide/limit members can limit and guide a cardboard sheet folded to approximately 90° and having an initial folding interval in the sheet width direction, up to a predetermined guide interval which is the same interval as the predetermined folding width interval. Furthermore, the pair of pressing members approach and press the cardboard sheet connecting portions, which have a predetermined folding width interval at its natural length when folded to 180°, to a correction interval which is smaller than the predetermined folding width interval; the directions of crease formations in the connecting portions are thus accurately corrected.

In another preferred embodiment of the present invention, the pair of pressing members are disposed downstream in the feed direction from the pair of guide/limit members.

According to the preferred embodiment of the present invention described above, the connecting portion interval in the cardboard sheet width direction is first limited by pair of guide/limit members, and the initial crease formation positions in the connecting portions are thus determined. Because these initial crease formation positions shift outward due to contact friction resistance between the cardboard sheet and the folding belts etc., crease formation position offsets are corrected by the pair of pressing members. As a result, in the preferred embodiment of the present invention, the initial crease formation position offsets determined by the guide/limit members are corrected with successive accuracy by the pair of pressing members on the downstream side, and fish-tail-shaped splaying is prevented.

In another preferred embodiment of the present invention, each of the pair of pressing members comprises a plurality of rotatable rolls disposed in the feed direction on a support member which is movable in the cardboard sheet width direction, and the plurality of rolls are driven by a single drive motor fixed on the support member.

According to the preferred embodiment of the present invention described above, each of the pressing members comprises a plurality of rotatable rolls disposed on the support member, and the plurality of rolls are driven by the single motor to press the connecting portions. As a result, in the preferred embodiment of the present invention, because the friction resistance received by connecting portions is small even during the period when the connecting portions are being pressed by the plurality of rolls, there is no disturbance to the feed state of the connecting portions, including the feed speed, feed direction and so forth.

In another preferred embodiment of the present invention, the folder gluer further comprises movable members movable in the cardboard sheet width direction, support members for respectively supporting the pair of pressing members, and pressing drive sources respectively fixed to the movable members for moving the support members in the cardboard sheet width direction, wherein the controller controls driving of the pressing drive sources based on the approach timing and the separation timing.

According to the preferred embodiment of the present invention, the controller controls the pressing the drive sections using the approach timing and the separation timing, and the support members respectively supporting the pair of pressing members are moved in the cardboard sheet width direction by the pressing drive sources on the movable members. As a result, in the preferred embodiment of the present invention, the stroke through which each of the pair of pressing members moves during the pressing operation is set at a relatively small degree of movement of the support member with respect to the movable member, even when the cardboard sheet width changes due to an order change, for example when the predetermined folding width interval changes, therefore corrections of the crease formation positions in the connecting portions are fast and accurate, compared to the case in which there is a relatively large movement of each of pressing members relative to a folder gluer frame.

In another preferred embodiment of the present invention, the folder gluer further comprises stopper members for determining stopping positions of the support members in the cardboard sheet width direction when the stopping members are moved by the pressing drive sources.

According to the preferred embodiment of the present invention, when the stopping members are moved by the pressing drive sections, the stopping positions of the support members in the cardboard sheet width direction are determined by the stopper members. As a result, in the preferred embodiment of the present invention, the distance between the pair of the pressing members in the proximate state is accurately set and correction accuracy in the connecting portions is improved.

In another preferred embodiment of the present invention, the pair of guide/limit members are respectively supported by a pair of first movable members movable in the cardboard sheet width direction, the pair of pressing members are respectively supported by the pair of support members movable in the cardboard sheet width direction by a pair of pressing drive sources fixed on a pair of second movable members movable in the cardboard sheet width direction, the pair of first movable members are moved in the cardboard sheet width direction by a pair of first width direction drive members, the pair of second pair of movable members are moved in the cardboard sheet width direction by a pair of second width direction drive members, and the controller controls the driving of the first and second width direction drive members in such a way that the distance between the pair of guide/limit members and the distance between the pair of pressing members in a separation state correspond to a predetermined width dimension of the connected second and third panels in the cardboard sheet width direction.

According to the preferred embodiment of the present invention, the pair of guide/limit members are respectively supported by the pair of first movable members, and the pair of pressing members are respectively supported by the pair of support members on the pair of second movable members. The controller controls the driving of the first and second width direction drive members in such a way that the distance between the pair of guide/limit members and the distance between the pair of pressing members in the separated state are distances which correspond to the width dimension in the cardboard sheet width direction of the connected second and third panels. As a result, in the preferred embodiment of the present invention, the pair of guide/limit members guide and limit the connecting portions in accordance with the predetermined width dimension which differs for each order, and the pair of pressing members in the separated state at the least does not disturb the feed state of the folded cardboard sheet. In other words, when the distance between the pair of pressing members in the separated state is the same as the distance between the pair of guide/limit members, the pair of pressing members in the separated state can guide/limit the connected portions of the cardboard sheet, and when the distance between the pair of pressing members in the separated state is larger than the distance between the pair of guide/limit members, the separated pair of pressing members will not damage the flap portions of the cardboard sheet through contact with the flap portions.

The above and other objects and features of the present invention will be apparent from the following description by taking reference with accompanying drawings employed for preferred embodiments of the present invention.

DETAILED DESCRIPTIONS OF THE PREFERRED EMBODIMENTS

First Embodiment

Hereinafter, the preferred embodiments of the present invention will be explained with reference to the attached drawings.

First, referring to FIGS. 1 through 19, a folder gluer according to a first embodiment of the present invention will be explained. The folder gluer according to the first embodiment glues a single flap cardboard sheet while folding it.

In general, cardboard sheet box making machines, including folder gluers, are configured with a plurality of processing devices disposed along the feed direction of the cardboard sheet. Cardboard sheet box making machines are provided with a cardboard sheet supply device, a printing device, and a creaser slotter device upstream of the gluer folder, and a counter/ejector for accumulating and ejecting cardboard sheet which has been folded and glued downstream of the gluer folder. Cardboard sheet box making machines of this type are known through JP-9-165124A and the like, so we will omit discussion thereof except with respect to the folder gluer. The up-down directions, left-right directions, and front-back directions follow the directions shown by the arrows in drawings.

Machine Overview

Figure 1:
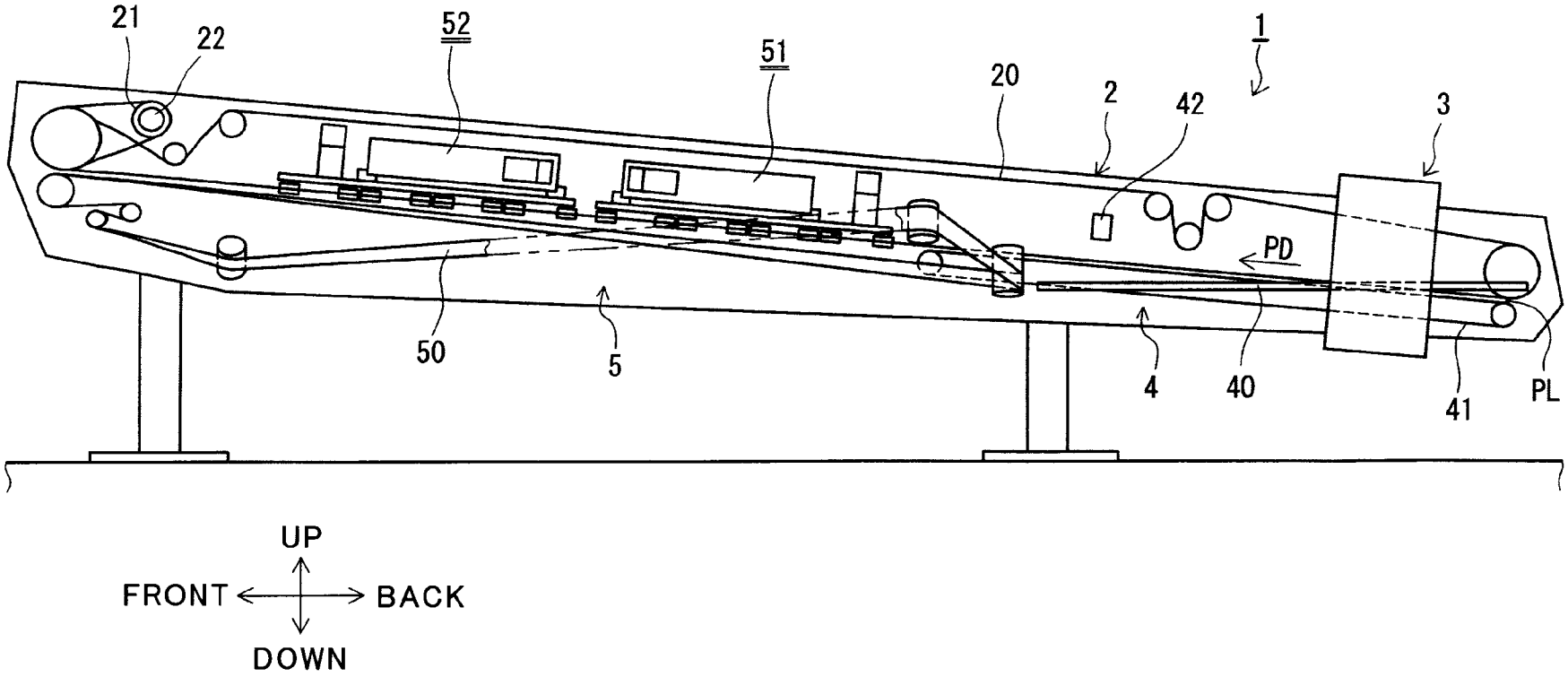
FIG. 1 is an overview showing a folder gluer according to a first embodiment of the present invention.

As shown in FIG. 1, a folder gluer 1 is a processing device supplied with a single flap cardboard sheet SS in feed direction PD extending from the back to the front in FIG. 1; it folds and glues that cardboard sheet SS, discharging the glued cardboard sheet SS to a counter/ejector. The single flap cardboard sheet SS has first through fourth panels P1-P4 along the sheet width direction WD perpendicular to the feed direction PD, and a glue tab GS on the edge of the first panel. Creases K1-K4 are respectively formed by the creaser slotter device on the portion joining the first panel P1 and the glue tab GS, and on the portion joining each panel with each other panel; slots S1-S3 are formed at only the front edge FE of the cardboard sheet SS by the creaser slotter device. Each connecting portion has a predetermined depth distance CNL in a direction parallel to the feed direction PD from the terminus of each slot to the back edge BE of the cardboard sheet SS, and the distance between the connecting portion on which crease K2 is formed and the connecting portion on which crease K4 is formed is a predetermined width distance CNW along the sheet width direction WD. Each of the flap portions where slots S1-S3 are formed has a predetermined flat dimension FPL in a direction parallel to the feed direction PD from the front end FE of the cardboard sheet SS to the terminus of each of the slots.

As shown in FIG. 1, the folder gluer 1 is furnished with a feed device 2 for feeding cardboard sheets S along a feed path PL; a gluing device 3 for gluing the cardboard sheet SS to the glue tab GS; a first folding station 4 for folding the cardboard sheet SS first and fourth panels P1 and P4 from a flat state to approximately 90°; and a second folding station 5 for folding the first and fourth panels P1 and P4 from 90° to 180°.

Feed Device

A feed device 2 is disposed along the feed path PL over the entire width of the folder gluer 1 above the feed path PL; this is of the suction type, suctioning the top surface of the cardboard sheet SS and feeding it in the feed direction PD. The feed device 2 has a pair of upper feed belts 20, tension-mounted on the left and right sides of the feed path PL. The two upper feed belts 20 are suctioned upward by a suction device comprising a suction chamber and a suction blower. The two upper feed belts 20 have numerous suction holes and are driven by a feed motor 21; a feed amount detector 22 for detecting the amount by which the two upper feed belts 20 are fed is linked to the rotary shaft of the feed motor 21. The interval in the sheet width direction WD between the two upper feed belts 20 can be adjusted in accordance with the cardboard sheet SS predetermined width interval CNW.

Gluing Device

A gluing device 3 is disposed in proximity to the supply opening through which cardboard sheet SS is supplied to the folder gluer 1. The gluing device 3 coats glue onto the glue tab GS of the cardboard sheet SS fed from the supply opening. When the cardboard sheet SS is ejected from the folder gluer 1, the glue tab GS coated with glue is adhered to the fourth panel P4.

First Folding Station

Figure 4:
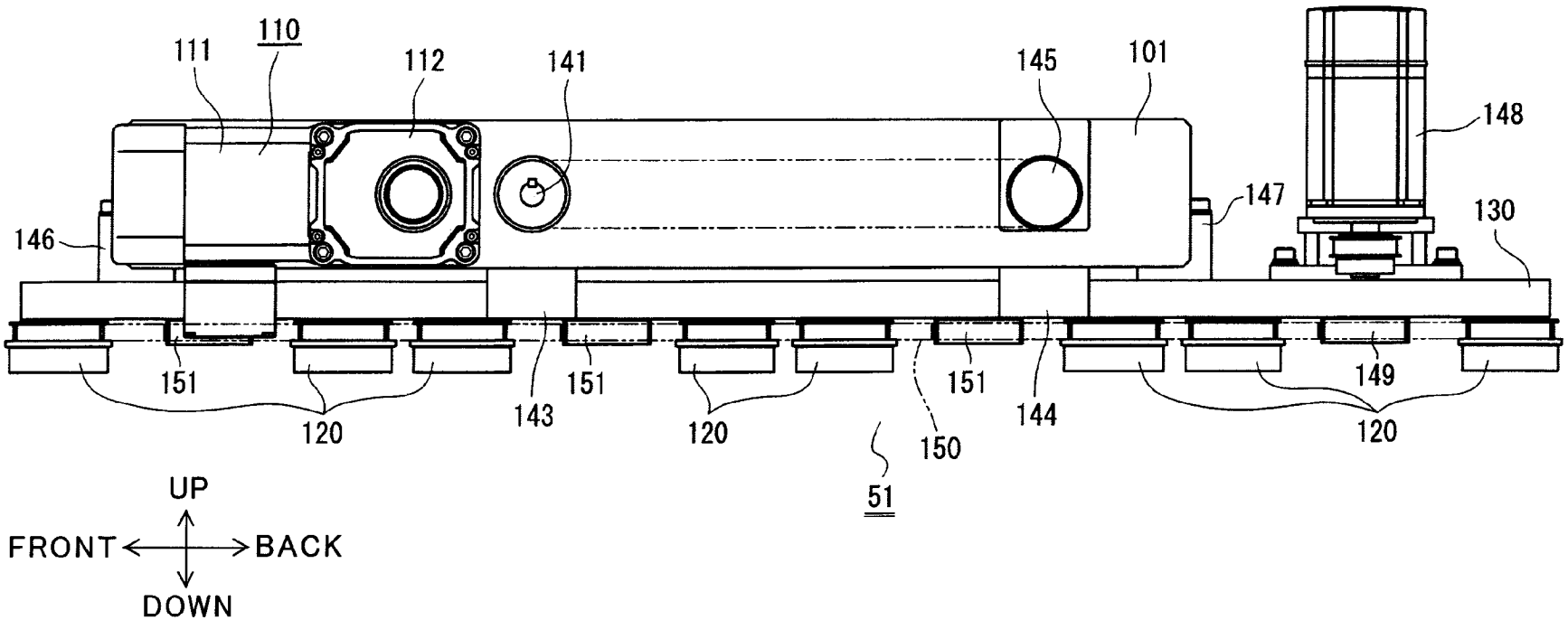
FIG. 4 is a left elevation view showing the guide/limit mechanism at the left side of FIG. 3.

As shown in FIG. 4, the first folding station 4 is furnished with a pair of panel folding bars 40 on the left and right side of the feed path PL for folding the first and fourth panels P1 and P4 of the cardboard sheet SS from a flat state to 90°, and a pair of lower feed belts 41 for feeding and supporting the cardboard sheet SS from below. The pair of panel folding bars 40 extend from the folder gluer 1 cardboard sheet SS supply opening to the upstream side of a second folding station 5, and is fixed to the folder gluer 1 machine frame. The pair of lower feed belts 41 are tension-mounted between the folder gluer 1 cardboard sheet SS supply opening and the upstream portion of the second folder station 5, and work together with the pair of upper feed belts 20 to feed the cardboard sheet SS.

A front edge detector 42 is disposed on the folder gluer 1 machine frame on the upstream side of the second folding station 5. The front edge detector 42 optically detects the passage of the front edge FE of a cardboard sheet SS fed along the feed path PL.

Second Folding Station

A second folding station 5, as shown in FIG. 1, is furnished on the left and right side of the transfer path PL with a pair of panel folding belts 50, driven in order to fold the cardboard sheet SS first and fourth panels P1 and P4 from 90° to 180°; a pair of guide/limit mechanisms 51 for guiding and limiting both connecting portions of the folded first and fourth panels P1 and P4; and a pair of pressing mechanisms 52 for correcting the direction of crease formation formed by the first and fourth panels P1 and P4.

The pair of panel folding belts 50 are disposed over the entire length of the second folding station 5 and have a contact surface capable of contacting the first and fourth panels P1 and P4. The contact surfaces of each panel folding belt are positioned in a vertically upright state on the upstream side of the feed path PD, and each panel folding belt is tension-mounted using multiple rollers so that the belts gradually slope as they move downstream, ultimately becoming flat. The distance between the two panel folding belts 50 in the sheet width direction WD is adjustable in accordance with the predetermined width distance CNW of the cardboard sheet SS. The basic structure of the panel folding belt is described in JP-2007-185788A.

Guide/Limit Mechanism

The pair of guide/limit mechanisms 51 have the same structure, therefore the guide/limit mechanism 51 disposed on the left side of the feed path PL are explained by reference to FIGS. 3 through 5. The guide/limit mechanism 51 is furnished with a guide support frame 100 fixed to the folder gluer 1 machine frame; a drive device 110 fixed to the guide support frame 100; a support plate 130 for supporting numerous gauge rolls 120; and a movement mechanism 144 moving support plate 130 in the sheet width direction WD by being driven by drive device 110.

Figure 3:
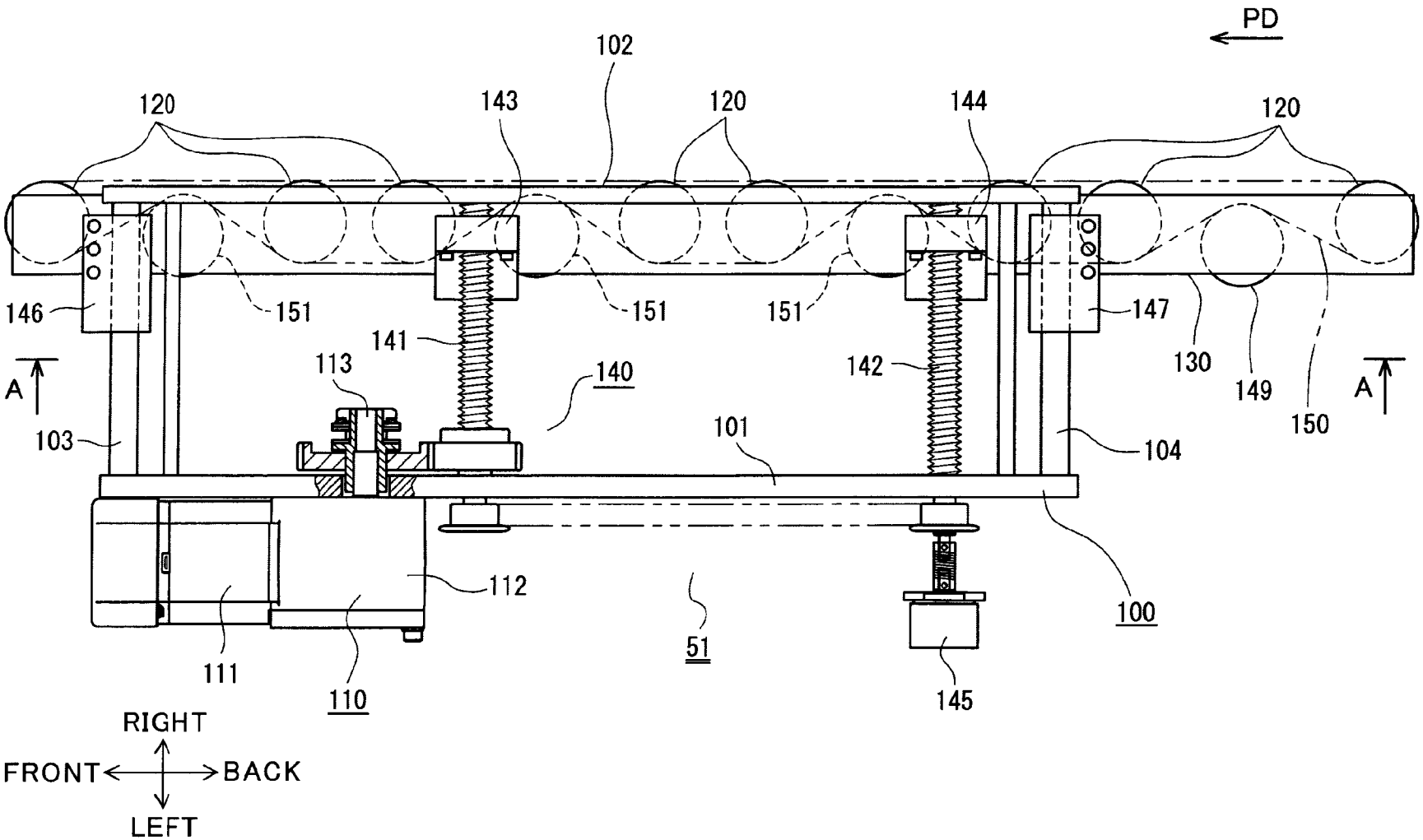
FIG. 3 is a plan view showing a guide/limit mechanism at the left side of a folder gluer according to a first embodiment of the present invention.

As shown in FIG. 3, the guide support frame 100 is furnished with mutually opposing a pair of fixing plates 101 and 102 and a pair of guide bars 103 and 104, respectively installed between the front edge and rear edge of each fixing plate.

As shown in FIG. 3, the drive device 110 is fixed to the guide support frame 100 fixing plates 101. The drive device 110 is furnished with a first drive motor 111 comprising a servomotor and an output direction conversion mechanism 112 comprising a bevel gear. The drive device 110 is fixed to the fixing plate 101 in a state whereby the rotary shaft of the first drive motor 111 extends in a back to front direction. The output direction conversion mechanism 112 has an output shaft 113 extending in a left to right direction perpendicular to the rotary shaft of the first drive motor 111.

As shown in FIG. 3, a movement mechanism 140 is furnished with a pair of screw shafts 141 and 142 installed between the pair of fixing plates 101 and 102, and a pair of nut members 143 and 144 thread-mounted onto both screw shafts. The screw shaft 141 is linked to the output shaft 113 of the output direction conversion mechanism 112 through a gear mechanism. The screw shaft 142 is linked to the screw shaft 141 through a chain belt mechanism.

Figure 5:
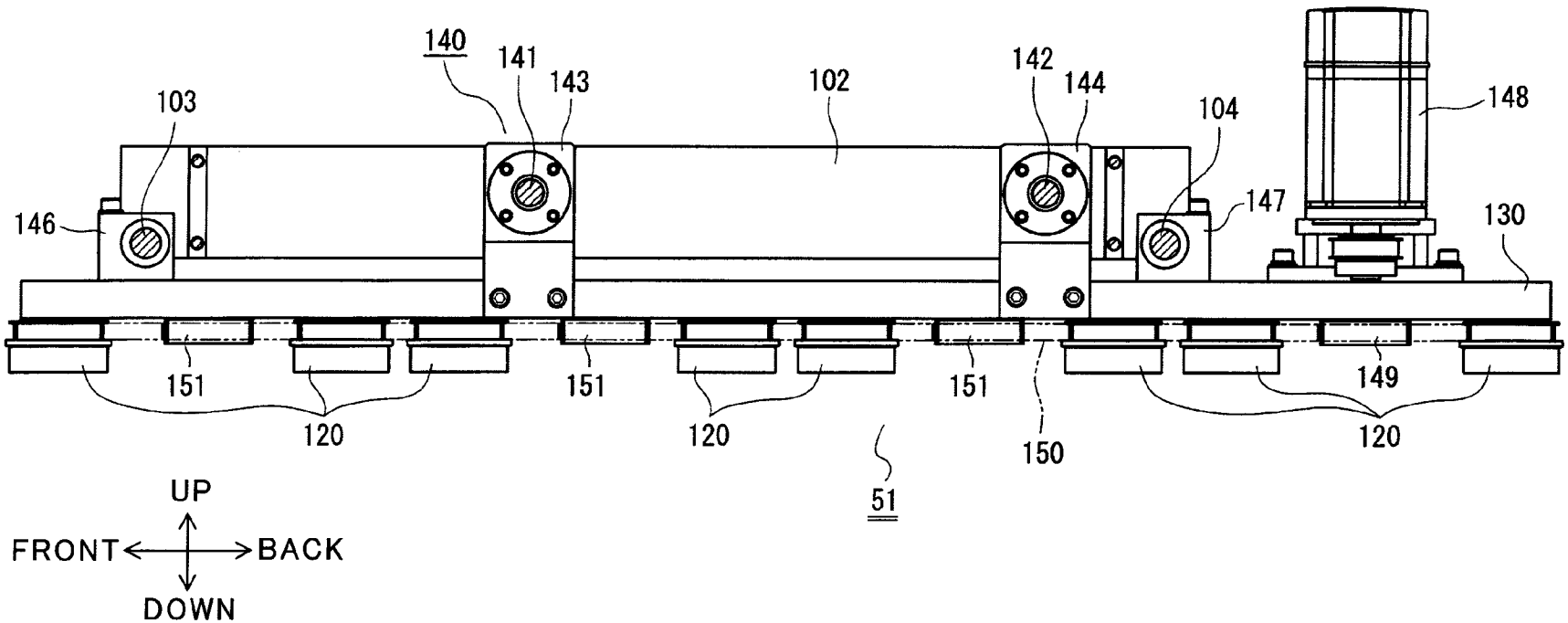
FIG. 5 is a partial cross-sectional view showing the guide/limit mechanism at the left side of FIG. 3, seen along line A-A.

As shown in FIG. 5, the pair of nut members 143 and 144 comprise engaging portions which respectively thread-mount on the pair of screw shafts 141 and 142, and hanging portions extending downward. Each of the downward hanging portions is fixed to the side surface of a support plate 130. As shown in FIG. 5, a pair of retaining plates 146 and 147 are fixed to the top surface of the support plate 130; each retaining plate has a through hole penetrating in the left-right direction. The pair of guide bars 103 and 104 of the guide support frame 100 are inserted into the through holes in the two retaining plates 146 and 147, guiding the support plate 130 in the left-right direction.

In the folder gluer of the first embodiment, the eight gauge rolls 120 are arrayed in the feed direction as shown in FIG. 3, and are rotatably supported on the bottom surface of the support plate 130. As shown in FIG. 4, a first roll-turning motor 148 is fixed to the top surface of the support plate 130 with the rotary shaft extending in a vertical direction, and is connected through a known power transfer mechanism to a drive pulley rotatably supported on the bottom surface of the support plate 130. A timing belt 150 is tension-mounted via three tension pulleys 151 in order to transfer the rotation of the drive pulley 149 to the eight gauge rolls 120. Note that an illustration of the first roll rotating motor 148 is omitted in FIG. 3 for simplicity.

The support plate 130 is positioned in the sheet width direction (the left-right direction) by the rotation of the movement mechanism 140 in accordance with the cardboard sheet SS predetermined interval CNW. In the folder gluer of the first embodiment, the eight gauge rolls 120 disposed on the left side of the feed path PL and the eight gauge rolls 120 disposed on the right side of the feed path correspond to the pair of guide/limit members of the present invention. In the first embodiment, the nut members 143 and 144 and the support plate 130 disposed on the left side of the feed path PL, as well as the nut members 143 and 144 and the support plate 130 disposed on the right side of the feed path PL, correspond to the first pair of movable members of the present invention. The first drive motor 111 in the first embodiment corresponds to the first width direction drive section of the present invention.

Pressing Mechanism

The pair of pressing mechanisms 52 are disposed downstream from the pair of guide/limit mechanisms 51 in the feed direction PD. Since the pair of pressing mechanisms 52 have the same structure, an explanation of the pressing mechanism 52 disposed on the left side of the feed path PL is given by reference to FIGS. 6 through 9. The pressing mechanism 52 comprises a correction support frame 200 fixed to the folder gluer machine frame; a drive device 210 fixed to the correction support frame 200; a support plate 230 supporting numerous pressing rolls 220; a movement mechanism for moving members linked to the support plate 230 in the sheet width direction under the drive of drive device 210; and a pressing mechanism 260 for imparting pressing motion to the support plate 230.

Figure 6:
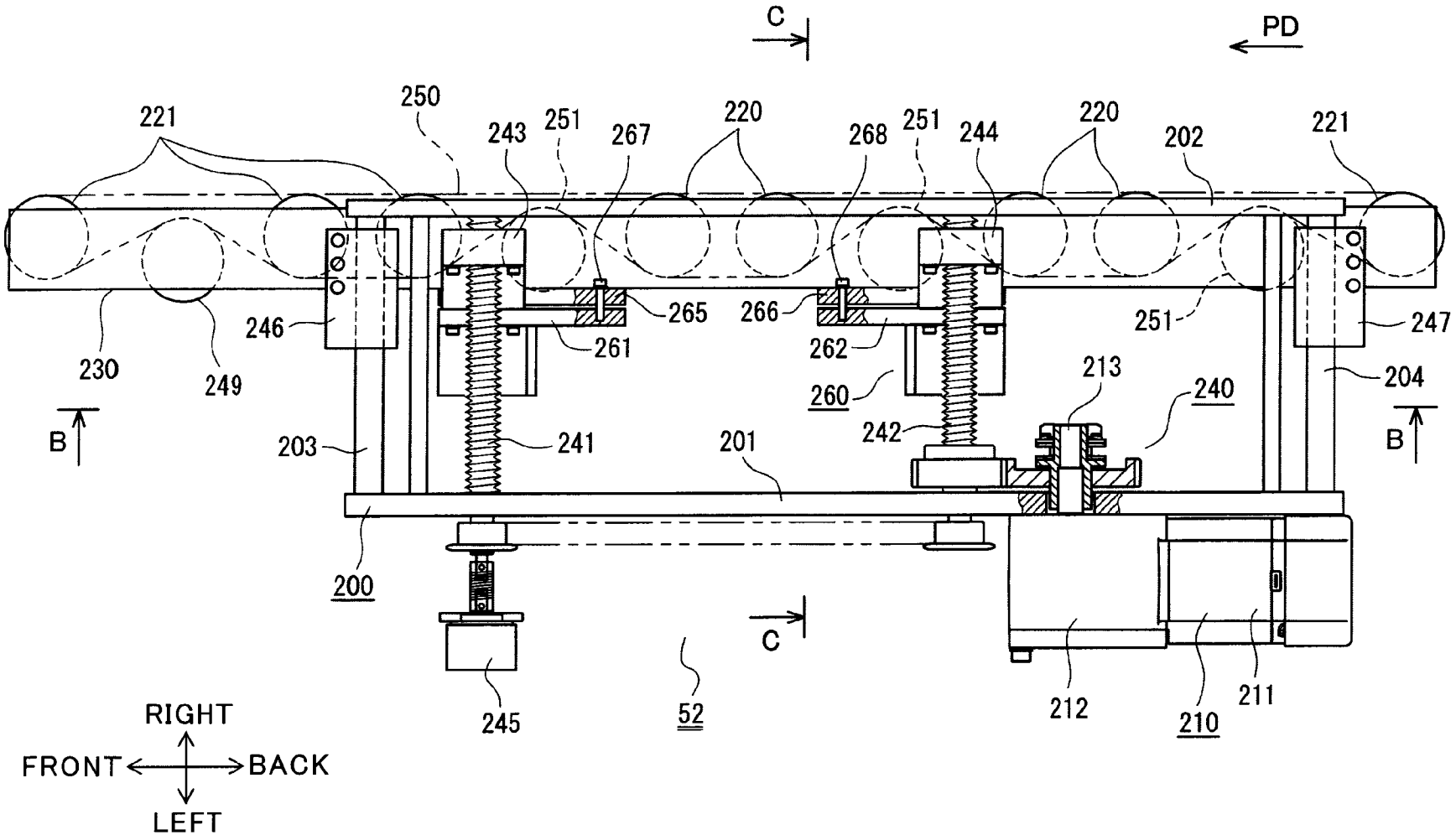
FIG. 6 is a plan view showing a pressing mechanism at the left side of the folder gluer according to a first embodiment of the present invention.

As shown in FIG. 6, the correction support frame 200 comprises mutually opposing a pair of fixing plates 201 and 202, and a pair of guide bars 203 and 204, respectively mounted between the front edge and the rear edge of the two fixing plates.

As shown in FIG. 6, the drive device 210 is fixed to the correction support frame 200 fixing plate 201. The drive device 210 comprises a second drive motor 211 consisting of a servomotor and an output direction conversion mechanism 212 consisting of a known bevel gear. The driver device 210 is fixed to the fixing plate 201 with the rotary shaft of the second drive motor 211 extending in a front-rear direction. The output direction conversion mechanism 212 has an output shaft 213 extending in a left-right direction, perpendicular to the rotary shaft of the second drive motor 211.

As shown in FIG. 6, a movement mechanism 240 comprises a pair of screw shafts 241 and 242 mounted between a pair of fixing plates 201 and 202, and a pair of nut members 243 and 244 thread-mounted on screw shafts. The screw shaft 242 is connected through a gear mechanism to the output shaft 213 on the output direction conversion mechanism 212. The screw shaft 241 is connected through a chain belt mechanism to the screw shaft 242. A second rotation detector 245 is connected to the screw shaft 241 to detect the amount of rotation and direction of rotation of the screw shaft 241.

Figure 8:
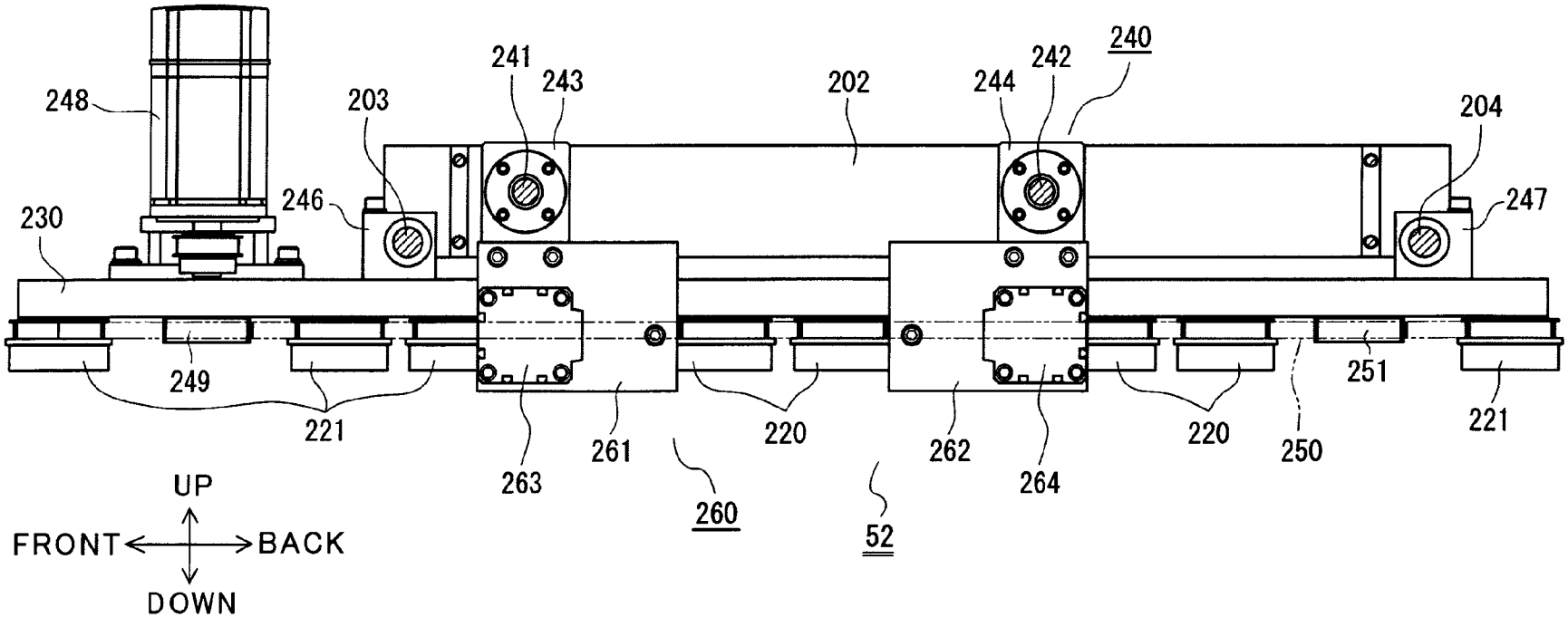
FIG. 8 is a partial cross-sectional view showing the pressing mechanism on the left side of FIG. 6, seen along line B-B.

As shown in FIG. 8, a pair of nut members 243 and 244 comprise: a pair of screw shafts 241 and 242; engagement portions respectively thread-mounted thereto; and downward extending hanging portions. A pair of retaining plates 246 and 247 are fixed to the top surface of a support plate 230, and each retaining plate has a through hole penetrating in the left-right direction. A pair of guide bars 203 in 204 on the correction support frame 200 are inserted into the screw holes in each retaining plate 246 and 247, guiding the support plate 230 in the left-right direction.

Figure 7:
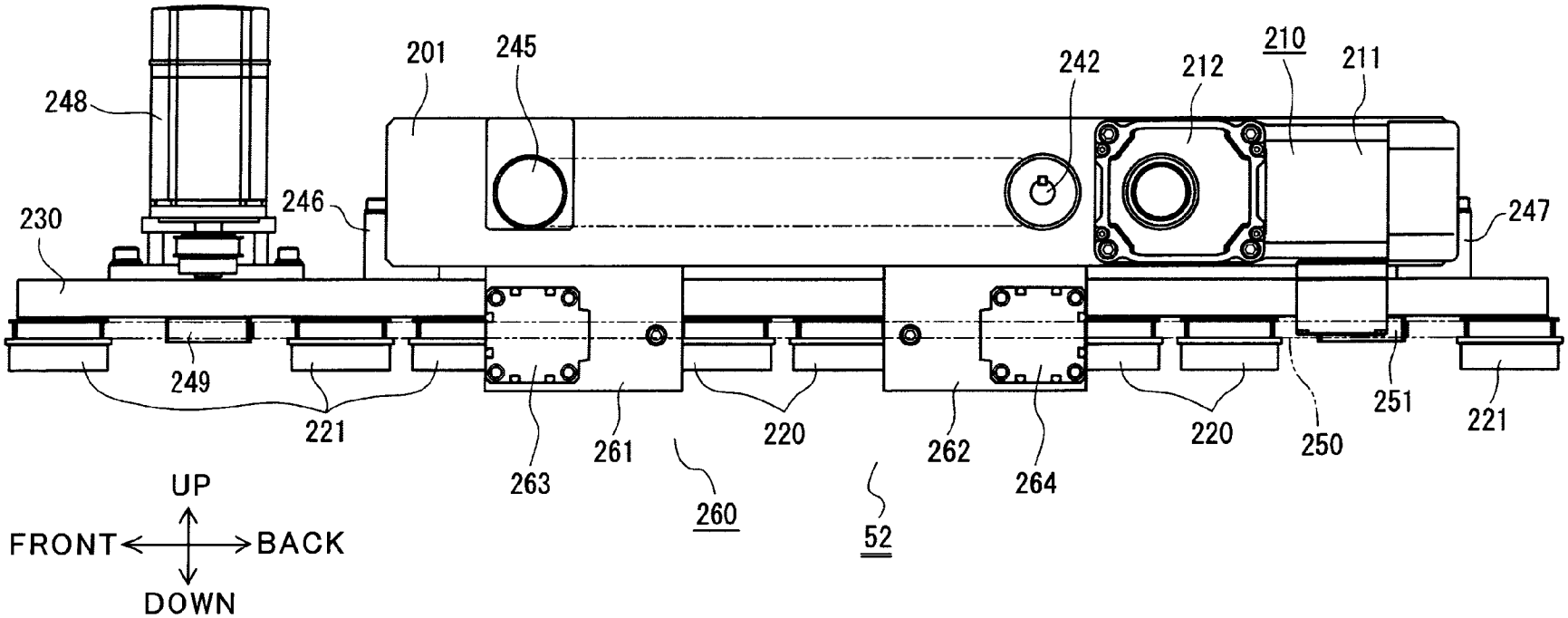
FIG. 7 is a left elevation view showing the pressing mechanism at the left side of FIG. 6.

In the folder gluer according to the first embodiment, four pressing rolls 220 and four gauge rolls 221 are arrayed in the direction of feed as shown in FIG. 6, and are rotatably supported on the bottom surface of the support plate 230. More specifically, a single gauge roll 221 is disposed on the upstream side of the four pressing rolls 220, and three gauge rolls 221 are disposed on the downstream side of the four pressing rolls 220. The diameter of each pressing roll 220 is set to be larger than the diameter of each of the gage rolls 221, and the diameter of each gauge roll 221 is set to be the same as the diameter of each of the gauge rolls in the guide/limit mechanism 51. The circumferential surface of the pressing roll 220 protrudes to the feed path PL in FIG. 6 from the gauge roll 221 circumferential surface by the amount of radial difference between the two rolls. For this reason, the pressing action with respect to the panel connecting portion is carried out by the pressing roll 220 alone; the gauge roll 221 is not involved in the pressing action. In the folder gluer according to the first embodiment, four pressing rolls 220 are used on one side but the gauge rolls 221 can be replaced by pressing rolls 220 in accordance with the length of the panel connecting portion. As shown in FIG. 7, a second rotary motor 248 is fixed to the top surface of support plate 230 with the rotary shaft extended in the vertical direction, and is connected via a known power transfer mechanism with a drive pulley 249 rotatably supported on the bottom surface of the support plate 230. A timing belt 250 is tension-mounted via three tension pulleys 251 to transfer the rotation of the drive pulley 249 to the four pressing rolls 220. Note that in FIG. 6 a diagram of the second roll motor 248 was omitted for simplicity.

Figure 9:
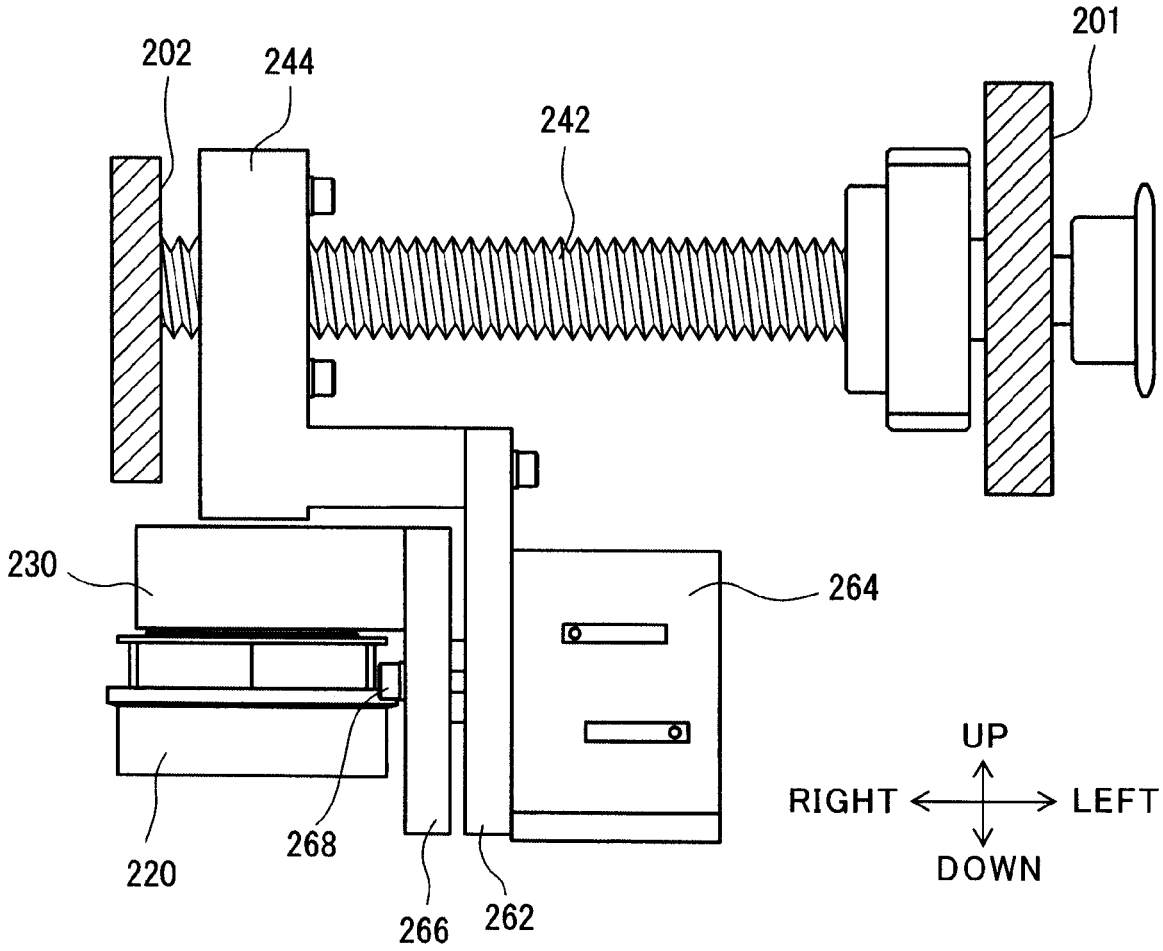
FIG. 9 is a partial cross-sectional view showing the pressing mechanism at the left side of FIG. 6, seen along line C-C.

As shown in FIG. 8, a pressing mechanism 260 comprises a pair of retaining plates 261 and 262 fixed to the hanging portion of the pair of nut members 243 and 244, and a pair of air cylinders 263 and 264 fixed to the pair of retaining plates 261 and 262. As shown in FIGS. 6 and 9, the pair of air cylinders 263 and 264 are respectively connected to the movable plates 265 and 266. The movable plates 265 and 266 are connected on the side surface of the support plate 230. A pair of stopper bolts 267 and 268 are inserted into through holes formed in both movable plates 265 and 266 and screwed into both retaining plates 261 and 262. When the two air cylinders 263 and 264 protrude, they contact both stopper bolts 267 and 268 and are thus positioned. As a result, the four pressing rolls 220 supported by the support plate 230 are positioned at a predetermined pressing position for pressing the connecting portion of the cardboard sheet SS panels. The pressing position of the pressing rolls 220 in the sheet width direction WD is adjusted by changing the amount by which the two stopper bolts 267 and 268 are screwed into the two retaining plates 261 and 262.

In the folder gluer according to the first embodiment, the set of pressing rolls 220 is disposed on the left and right side of the feed path PL, but the pressing stroke moved by the set of pressing rolls 220 disposed on the one side thereof in order to move the cardboard sheet panel connecting portion is set at 2 mm, which is approximately ¼ of one flute pitch of the corrugated medium regarding the A flute of the cardboard sheet SS. The set of pressing rolls 220 on the left and right side is therefore arranged to press the panel connection portions by a 4 mm, which is approximately ½ of one flute pitch of the corrugated medium. The aforementioned pressing stroke is the amount of movement of the movable plates 265 and 266 relative to the retaining plates 261 and 262, therefore the pressing stroke is set at 2 mm by using the amount by which the stopper bolts to 67 and 268 are screwed into the retaining plates 261 and 262.

The support plate 230 is positioned in the sheet width direction (the left-right direction) by the rotation of the second drive motor 211 in accordance with the cardboard sheet SS predetermined interval CNW. The support plate 230 moves in the sheet width direction with respect to the two retaining plates 261 and 262 in order for the pressing rolls 220 to press the connecting portion of the first and fourth panels P1 and P4 of the cardboard sheet SS using the pressing mechanism 260.

In the folder gluer according to the first embodiment, the set of four pressing rolls 220 disposed on the left side of the feed path PL and the set of four pressing rolls 220 disposed on the right side of the feed path PL correspond to the pair of pressing members of the present invention, and also correspond to the multiple rolls of the present invention. In the folder gluer according to the first embodiment, the two nut members 243 and 244 and the two movable plates 265 and 266 disposed on the left side of the feed path PL, and the two nut members 243 and 244 and the two movable plates 265 and 266 disposed on the right side of the feed path PL correspond to the movable members, and to the second pair of movable members of the present invention. In the folder gluer according to the first embodiment, the support plates 230 disposed on the left and right sides of the feed path PL correspond to the pair of support members of the present invention. The drive motor 211 in the folder gluer according to the first embodiment corresponds to the second width direction drive section of the present invention. The second roll rotation motor 248 in the folder gluer according to the first embodiment corresponds to the drive motor of the present invention. The pair of air cylinders 263 and 264 in the first embodiment correspond to the pressing drive section of the present invention. The pair of stopper bolts 267 and 268 in the first embodiment correspond to the stopper member of the present invention.

Electrical Portions

Figure 10:
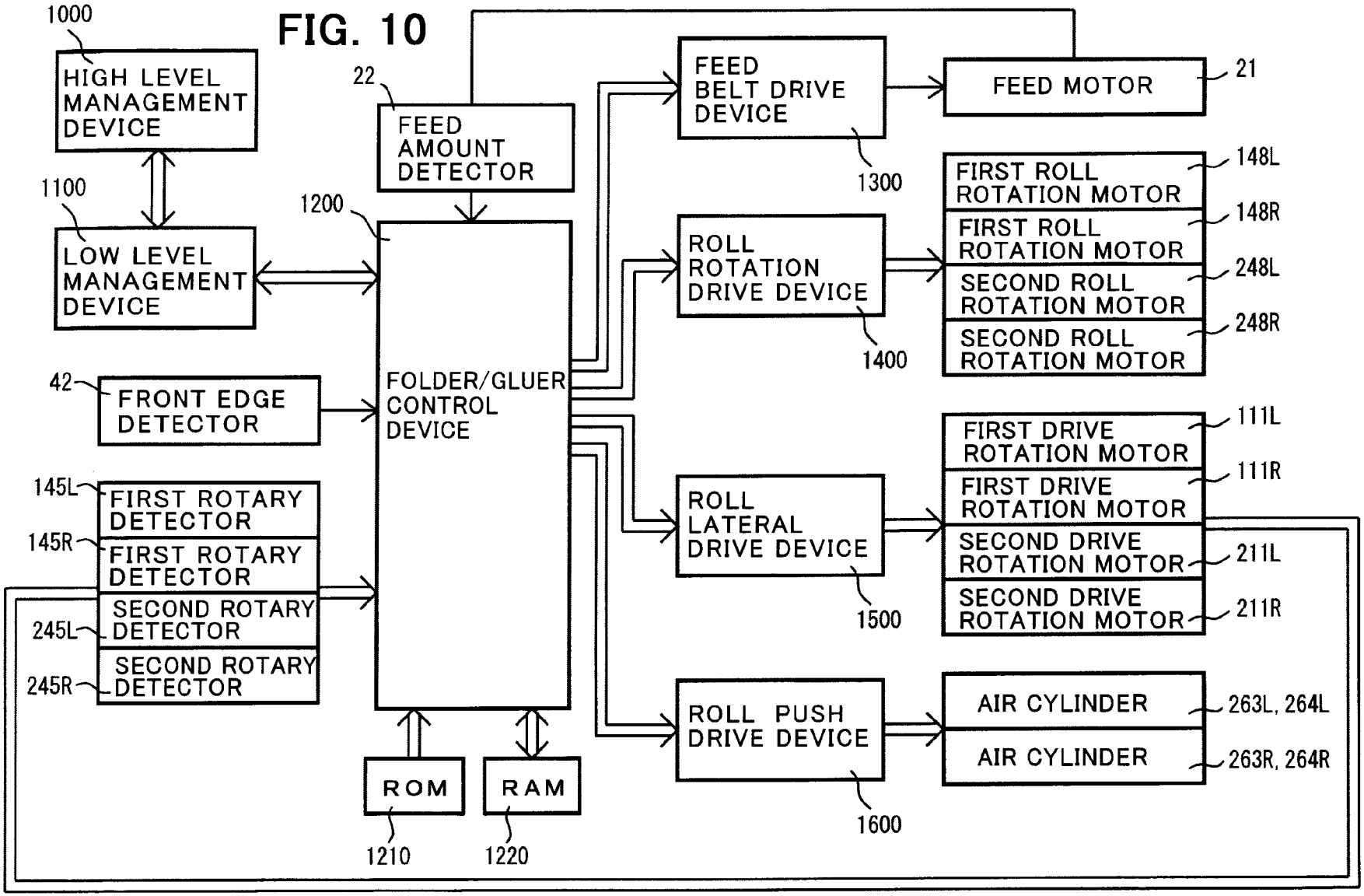
FIG. 10 is a block diagram showing the electrical portion of a folder gluer according to a first embodiment of the present invention.

Electrical portions of the folder gluer 1 according to the first embodiment are discussed with reference to FIG. 10. As shown in FIG. 10, a high level management device 1000 and a low level management device 1100 are furnished in a cardboard sheet box making machine to provide overall management of cardboard sheet processing. In the folder gluer according to the first embodiment, the high level management device 1000 sends to the low level management device 1100 control command information about the rotational speed, cardboard sheet size, processing quantities, and the like relative to the main motors, such as feed motor 21, under a predetermined processing management plan for a number of orders.

The low level management device 1100 operates the various processing devices in a cardboard sheet box making machine in accordance with control command information from the high level management device 1000, but since operations of other processing devices besides the folder gluer 1 of the present embodiment are known, control devices for controlling the operation of other processing devices are omitted in FIG. 10 and only electrical portions related to the folder gluer 1 control device are shown.

A folder gluer control device 1200 is supplied with control command information required for the operation of the folder gluer 1 by the low level management device 1100. control command information is information such as feed speed, the size of each portion of the cardboard sheet SS, the type and paper quality of cardboard sheet SS flutes, and volume to be processed. The folder gluer control device 1200 is respectively connected to a ROM1210 for storing programs such as the main control program and setting values to control the folder gluer 1 as a whole, and to a RAM1220 for temporarily storing calculated results, and forms a computer together with the ROM1210 and the RAM1220. The folder gluer control device 1200 is respectively connected to a feed belt drive device 1300, a roll rotation drive device 1400, a roll lateral drive device 1500, and a roll pressing drive device 1600, and controls the drive performed by each drive device. The folder gluer control device 1200 is also respectively connected to a feed amount detector 22 for detecting the amount of feed by the feed belt 20, and to a front edge detector 42 for detecting the passage of the front edge FE of the cardboard sheet SS; it receives a detection pulse signal for the amount of feed as well as a detection signal for the passage of the front edge. The folder gluer control device 1200 has an internal measurement counter for counting detection pulse signals from the feed amount detector 22 to measure the amount of feed; this internal counter starts its counting operation in response to a measurement command issued by the control processing of the folder gluer control device 1200.

In the folder gluer according to the first embodiment, the pair of guide/limit mechanisms 51 and the pair of pressing mechanisms 52 are disposed on the left and right side of the feed path PL, therefore in FIG. 10, the motor, air cylinder, and rotation detector comprising the mechanism on the left side are shown with the letter L, and the motor, air cylinder, and rotation detector comprising the mechanism on the right side are shown with the letter R. In FIG. 10 the roll rotation drive device 1400 receives a rotation control instruction containing a speed instruction from the folder gluer control device 1200, and in response to that instruction respectively drives the first roll rotation motors 148L and 148R and the second roll rotation motors 248L and 248R. A roll lateral drive device 1500 receives a rotation control instruction from the folder gluer control device 1200 instructing the amount of rotation and direction of rotation, and in response to that instruction respectively drives first drive motors 111L and second drive motors 211L and 211R. A roll pressing drive device 1600 receives a pressing control instruction from the folder gluer control device 1200 instructing the [starting] and stopping of pressing, and in response to that instruction activates electromagnetic valves on air cylinders 263 and 264 and on air cylinders 263 and 264.

The folder gluer control device 1200 is respectively connected to the first rotation detectors 145L and 145R and the second rotation detectors 245L and 245R, and receives detection pulse signals relative to the screw shaft 142, the amount of rotation by the screw shaft 241, and the direction of rotation. The folder gluer control device 1200 has four internal counters for position detection which count detection pulse signals from first and second rotation detectors 145L, 145R, 245L, and 245R detecting the current position in the sheet width direction of the nut members 143 and 144 and the nut members 243 and 244; each internal counter performs its counting operation independently of the folder gluer control device 1200.

Figure 11:
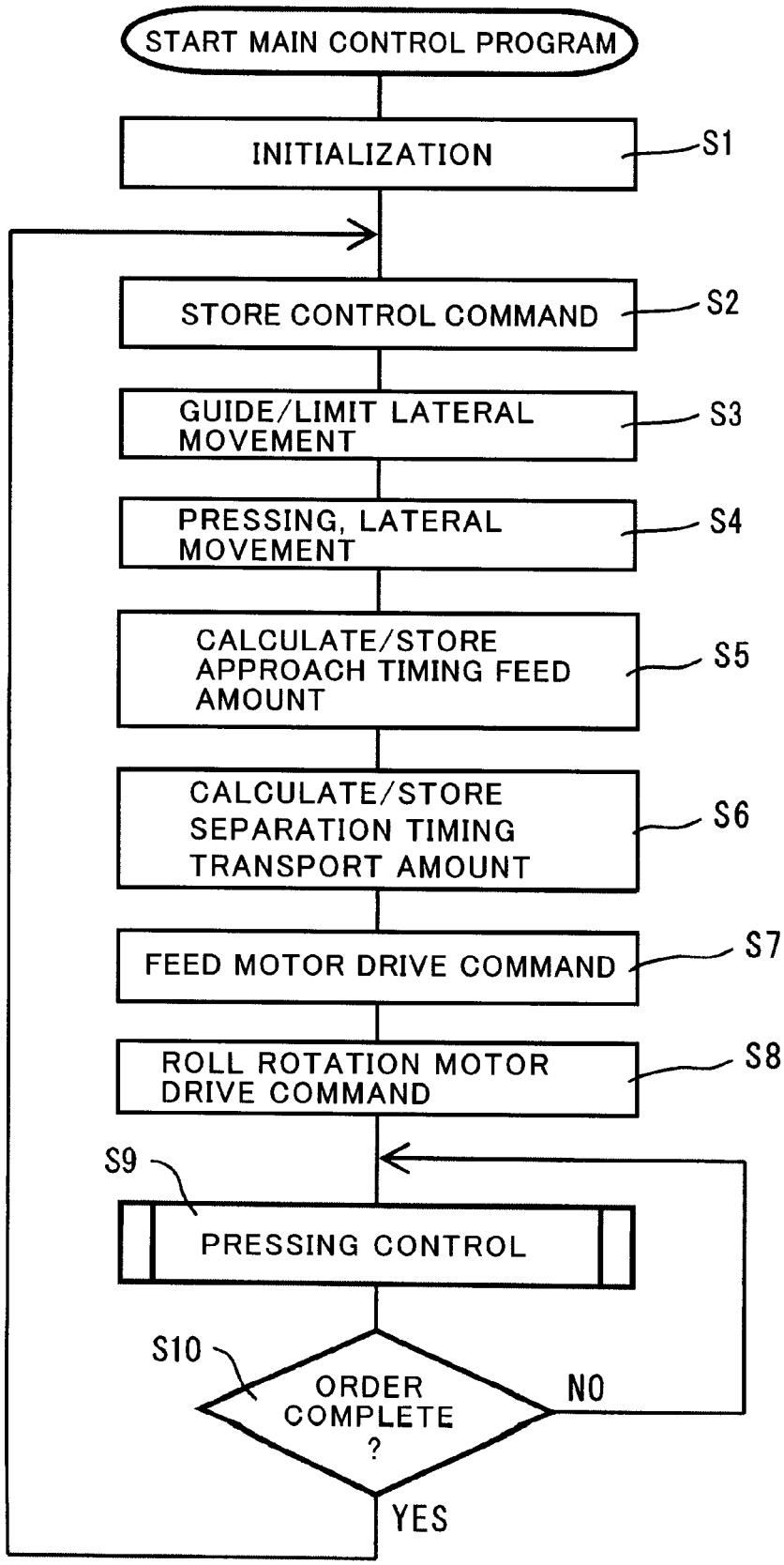
FIG. 11 is a flowchart showing the control executed by the main control program of the folder gluer control device in a folder gluer according to a first embodiment of the present invention.
Figure 12:
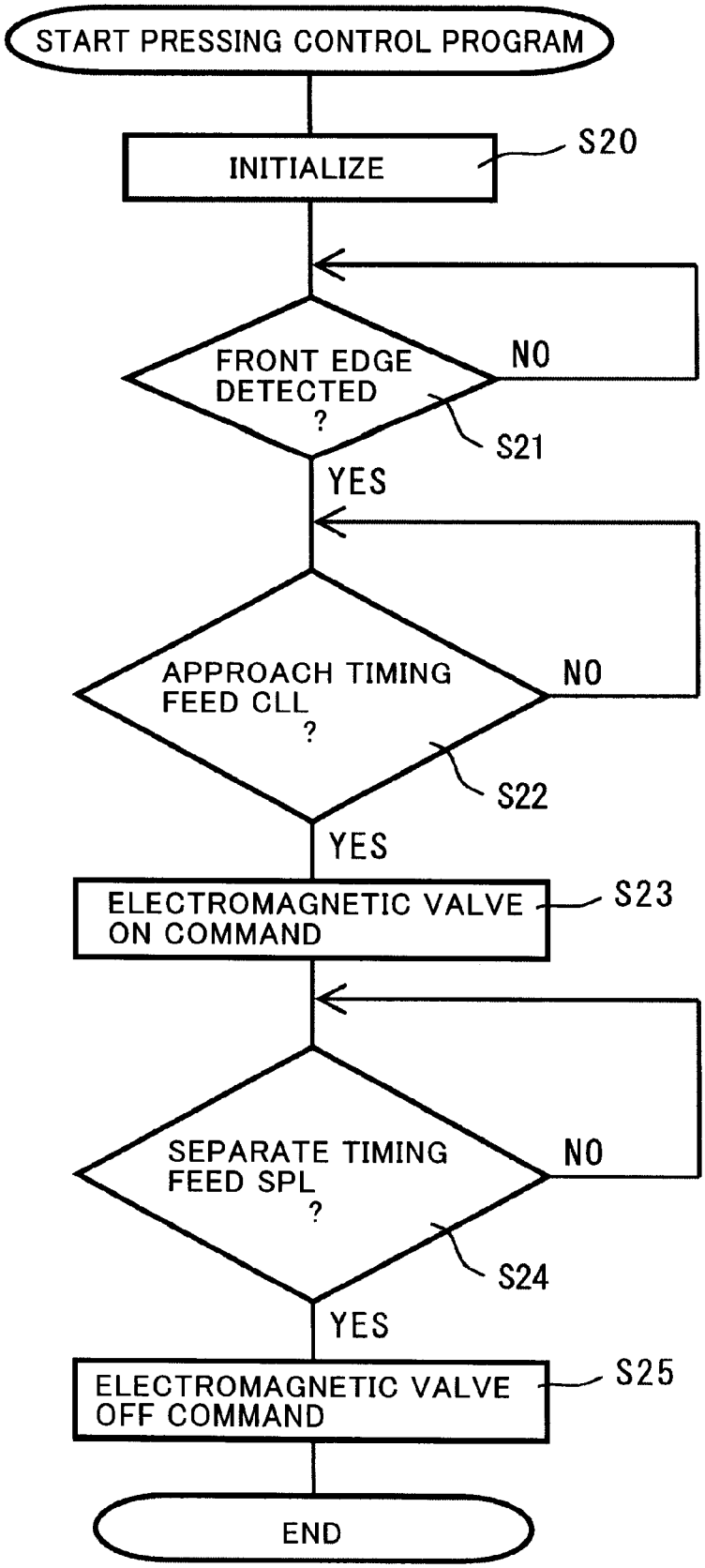
FIG. 12 is a flowchart showing the control executed by a pressing control program in the folder gluer control device of the folder gluer according to a first embodiment of the present invention.

The ROM1210 stores the main control program shown in FIG. 11 and the pressing control program shown in FIG. 12 as control programs. The main control program is a program for controlling the folder gluer 1 as a whole, and the pressing control program is a program for determining the timing at which the pressing rolls 220 on the left and right side approach one another and the timing at which they separate from one another in order to perform the pressing operation.

Operation of Folder According to First Embodiment

The operation of the folder gluer 1 according to the first embodiment of the present invention will be explained with reference to FIGS. 11 and 12.

Control Executed by Main Control Program

In the folder gluer according to the first embodiment, execution of the main program shown in FIG. 11 begins when power to the cardboard sheet box making machine is turned on. First, when executing a predetermined order currently in the processing management plan for multiple orders, the high level management device 1000 supplies information to the low level management device 1100 to instruct required control command information for executing a predetermined order, such as the cardboard sheet SS feed speed, the type of flute, the size of each part of the sheet, and the amount to be processed. The low level management device 1100 supplies control command information to the folder gluer control device 1200.

When execution of the main control program begins, initialization (S1) is executed and the content of the RAM1220 is cleared. Control command information is supplied from the low level management device 1100 and stored in the RAM1220 (S2). Control command information is information such as the speed command for the transfer motor 21 in accordance with the cardboard sheet SS feed speed, the speed command for the first and second first roll rotation motors 148L, 148R, 248L, and 248R, size information indicating the size of each part of the cardboard sheet SS, information indicating the cardboard sheet SS flute type, information indicating the quantity of processing for predetermined orders, and information about distances in the gauge rolls 120 on the left and right side and about the distance when the pressing rolls on the left and right side are separated.

Figure 13:
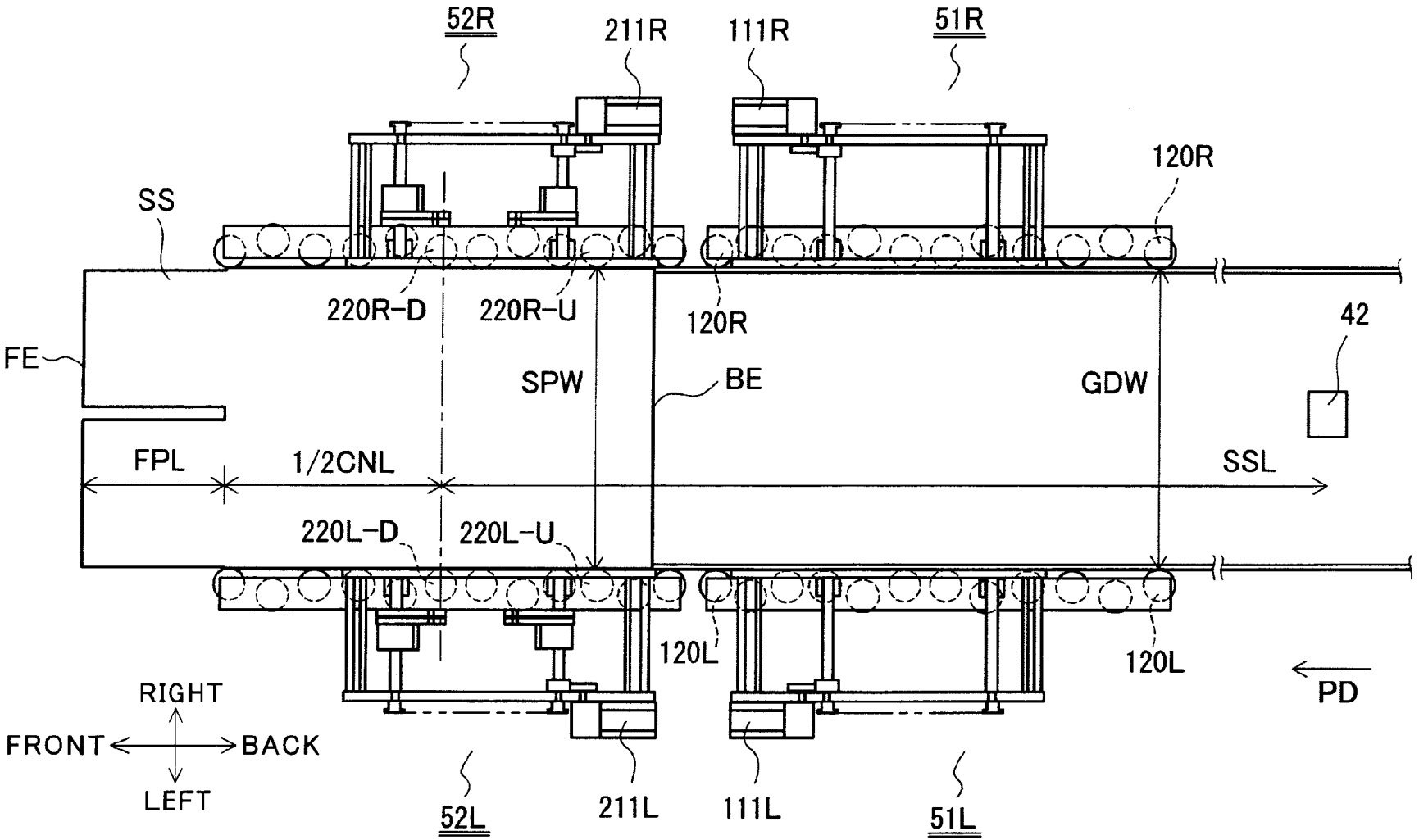
FIG. 13 is a plan view showing the state in which the center position of a panel connecting portion in a folder gluer according to a first embodiment of the present invention has reached the position at which the furthest downstream pressing rolls 220L-D and 220R-D are disposed.

As shown in FIG. 13, driving of the first drive motors 111L and 111R is controlled (S3) so that the distance between the pair of guide/limit mechanism 51 gauge rolls 120L and 120R is the predetermined guide distance GDW needed to guide/limit the connecting portion of the cardboard sheet SS panel, and the gauge rolls 120L and 120R on the left and right side are positioned at a predetermined position in the sheet width direction WD. The drive controls of the two drive motors 111L and 111R are the same, therefore we will discuss the drive control of the drive motors 111 and related mechanism operations with respect to only one of the guide/limit mechanisms 51.

Figure 19:
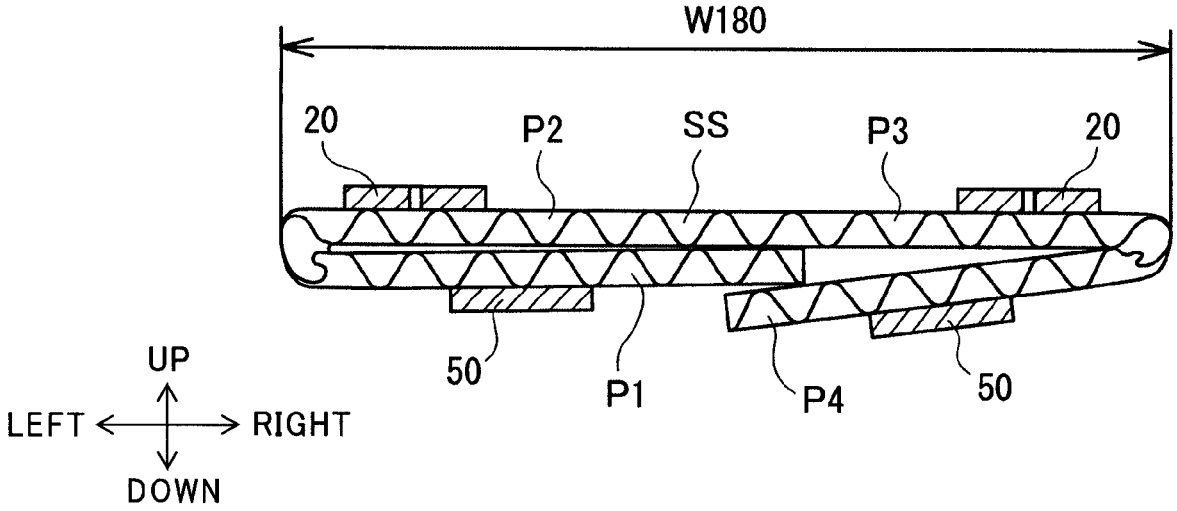
FIG. 19 is a cross-sectional view showing the state in which the first and fourth panels P1 and P4 in a folder gluer according to a first embodiment of the present invention are folded to 180°.

The predetermined guide distance GDW is set at a predetermined folding width interval W180 in the sheet width direction WD between the first panel P1 connecting portion and fourth panel P4 connecting portion, with the first and fourth panels P1 and P4 of the cardboard sheet SS folded to 180°, as shown in FIG. 19. This predetermined folding width interval W180 is predetermined in accordance with a predetermined cardboard sheet SS width interval CNW and sheet thickness. Information relating to the predetermined guide distance GDW is supplied as control command information from the low level management device 1100, and is recorded in the RAM1220 in step S2. With respect to the drive motor 111, when step S3 is executed a rotational direction and rotational amount for the drive motor 111 is instructed to the roll lateral drive device 1500 in accordance with the differential between the current position of the nut members 0143 and 0144 shown by the count value on the position detection internal counter, and the target position calculated from ½ the value of the predetermined guide distance GDW and the diameter of the gauge rolls 120, thus driving the drive motor 111. The screw shafts 141 and 142 are rotated by a drive force from the drive motor 111, moving the nut members 0143 and 0144 to the target position. The support plate 130 fixed to the nut members 0143 and 0144, as well as the gauge rolls 120, are positioned at a predetermined position, and the distances of the guide/limit mechanisms 51 gauge rolls 120 on the left and right side are set to predetermined guide distance GDW, as shown in FIG. 13.

As shown in FIG. 13, driving of the second drive motors 211L and 211R is controlled (S4) so that the distance when the pair of pressing mechanisms 52L and 52R pressing rolls 220L and 220R are separated is the predetermined separation distance SPW in accordance with the cardboard sheet SS flute type, and the left and right side pressing rolls 220L and 220R are thereby positioned at a predetermined position in the sheet width direction WD. The drive controls of both the drive motors 211L and 221R are the same, therefore we discuss below the drive motor 211 drive control and related mechanism operations with respect to only one of the pressing mechanisms 52.

Figure 2:
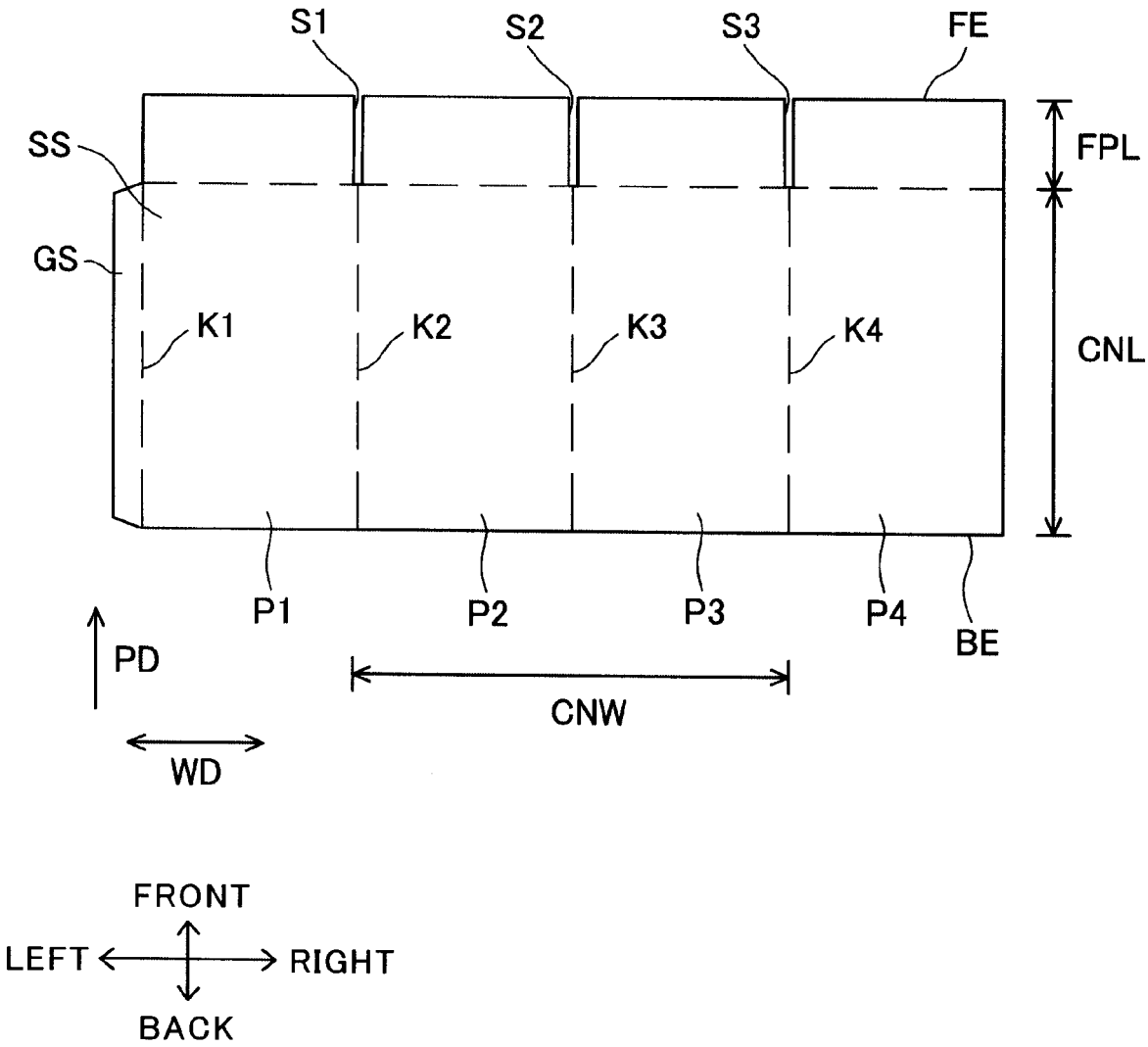
FIG. 2 is a plan view showing a single flap cardboard sheet SS.

The predetermined separation distance SPW is predetermined according to the cardboard sheet SS flute type, and more specifically according to the cardboard sheet SS predetermined width interval CNW shown in FIG. 2, as well as the sheet thickness, the flute pitch of the corrugated medium and the like. Information about the predetermined separation SPW is supplied as control command information from the low level management device 1100 and is stored in the RAM1220 in step S2. With respect to the drive motor 211, when step S4 is executed, a rotational direction and rotational amount for the drive motor 211 is instructed to the roll lateral drive device 1500 in accordance with the differential between the current position of the nut members 243 and 244 shown by the count value on the position detection internal counter, and the target position calculated from ½ the value of the predetermined separation distance SPW and the diameter of the pressing rolls 220, thereby driving the drive motor 211. The screw shafts 241 and 242 are rotated by the drive force from the drive motor 211, moving the nut members 243 and 244 to the target position. The retaining plates 261 and 262 fixed to the nut members 243 and 244, as well as the movable plates 265 and 266 which move together with the two retaining plates, and the support plate 230, are positioned at a predetermined position. As shown in FIG. 13, the distance between the pressing mechanism 52L and 52R pressing rolls 220L and 220R is set to be the separation distance SPW.

When the cardboard sheet SS flute type is an A flute, the predetermined separation distance SPW of the pressing rolls 220L and 220R is set to be the same as the gauge roll 120L and 120R predetermined guide distance GDW, and is the predetermined folding width interval W180. When the cardboard sheet SS flute type is other than an A flute, the predetermined separation distance SPW of the pressing rolls 220L and 220R is set to be larger than the gauge rolls 120L and 120R predetermined guide distance GDW. More specifically, when the other flute is a B flute, the predetermined separation distance SPW is set to be approximately 1 mm larger than the predetermined guide distance GDW. In the folder gluer according to the first embodiment, the pressing stroke moved by the set of pressing rolls 220 disposed on one side in order to move the cardboard sheet panel connecting portion is the amount by which the movable plates 265 and 266 can move with respect to the retaining plates 261 and 262, and is therefore set at 2 mm, which is approximately ¼ of one flute pitch of the A flute as a cardboard sheet SS A flute standard. If the flute is of the B type, on the other hand, the pressing amount by which the connecting portion is actually pushed by the pressing rolls 220 disposed on one side needs to be set at 1.5 mm, which is ¼ the flute pitch, and when the predetermined guide distance BTW is set at the predetermined folding width interval W180, the predetermined separation distance SPW of the pressing rolls 220L and 220R on the left and right sides becomes larger by 1 mm, which is twice the differential amount of 0.5 mm between the 2 mm pressing stroke and the 1.5 mm pressing amount in the B flute. The predetermined separation distance SPW is changed according to the flute type, therefore the distance CLW when the pressing rolls 220L and 220R are in a mutually proximate state is changed according to that change.

After the front edge detector 42 detects the front edge FE of the cardboard sheet SS, the cardboard sheet SS, as shown in FIG. 13, must be fed by a predetermined approach timing feed amount CLL by the time the center position of the panel connecting portion reaches the position at which the furthest downstream pressing rolls 220L and 220R are disposed and the pressing operation by both pressing rolls 220L and 220R is commenced. This feed amount CLL for a predetermined approach timing is calculated, and that calculation result is stored in the RAM1220 (S5). The feed amount CLL for a predetermined approach timing is calculated by summing the predetermined distance SSL up to the position at which the pressing rolls 220L and 220R are disposed furthest upstream from the position at which the front edge detector 42 is disposed, as shown in FIG. 13, plus ½ the value of predetermined depth dimension CNL of the cardboard sheet SS shown in FIG. 2, as well as the predetermined flap dimension FPL, then subtracting from that total a value corresponding to the air cylinder 263 and 264 electromagnetic valve turn on delay time. In step S2, information regarding the predetermined distance SSL, the predetermined depth dimension CNL, and the predetermined flap dimension FPL is supplied from the low level management device 1100 as control command information and stored in the RAM1220.

Figure 14:
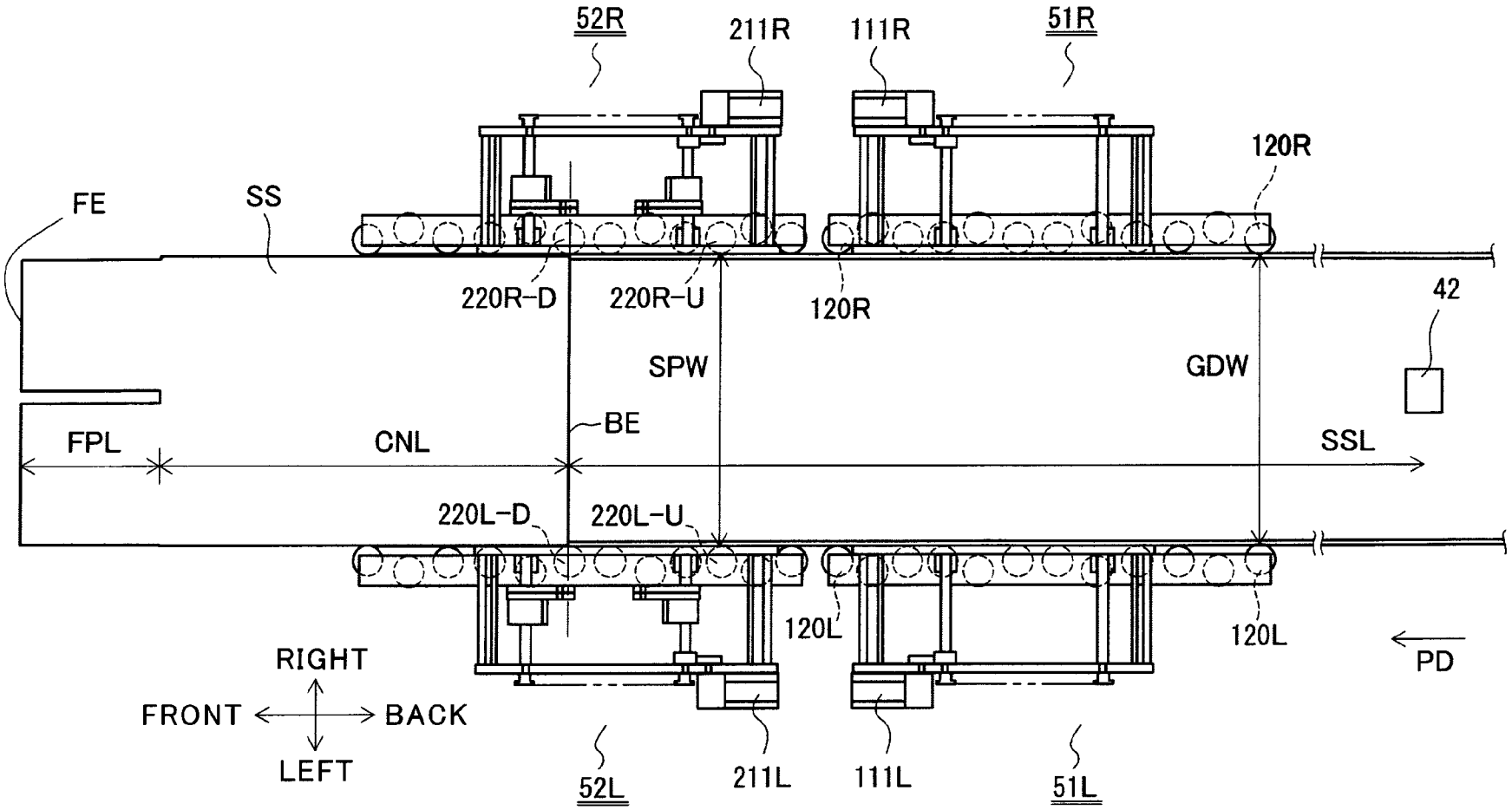
FIG. 14 is a plan view showing the state in which the terminus of a cardboard sheet in a folder gluer according to a first embodiment of the present invention has passed the positions at which the furthest downstream pressing rolls 220L-D and 220R-D are disposed.

After the front edge detector 42 detects the front edge FE of the cardboard sheet SS, the cardboard sheet SS, as shown in FIG. 14, must be fed by a predetermined separation timing feed amount SPL before the cardboard sheet SS back edge BE passes the position at which the furthest downstream pressing rolls 220L and 220R are disposed. This predetermined separation timing feed amount SPL is calculated, and that calculation result is stored in the RAM1220 (S6). The predetermined separation timing feed amount SPL is calculated by summing the predetermined distance SSL shown in FIG. 14, the predetermined depth dimension CNL, and the predetermined flap dimension FPL.

Driving of the feed motor 21 is instructed to the feed belt drive device 1300 in accordance with speed command information stored in the RAM1220 (S7). The feed motor 21 is driven so that the feed speed of the upper feed belt 20 is the predetermined speed instructed by the speed command information. Driving of the first roll rotation motors 148L and 148R and the second roll rotation motors 248L and 248R is commanded to the roll rotation drive device 1400 in accordance with speed command information stored in the RAM1220 (S8). The first roll rotation motors 148L and 148R are driven so that the speed of the cardboard sheet SS fed by the gauge rolls 120 is the feed speed of the upper feed belt 20, and the second roll rotation motors 248L and 248R are driven so that the speed of the cardboard sheet SS fed by the pressing rolls 220 is the feed speed of the upper feed belt 20.

When a cardboard sheet SS in a flat state such as is shown in FIG. 2 is supplied from a creaser slotter machine to the supply opening of folder gluer 1, the cardboard sheet SS is suctioned to the upper feed belt 20 as it is sandwiched by the drive [force] of the feed motor 21 between the upper transfer belt 20 and the lower feed belt 41, thus being fed in the feed direction PD.

Figure 15:
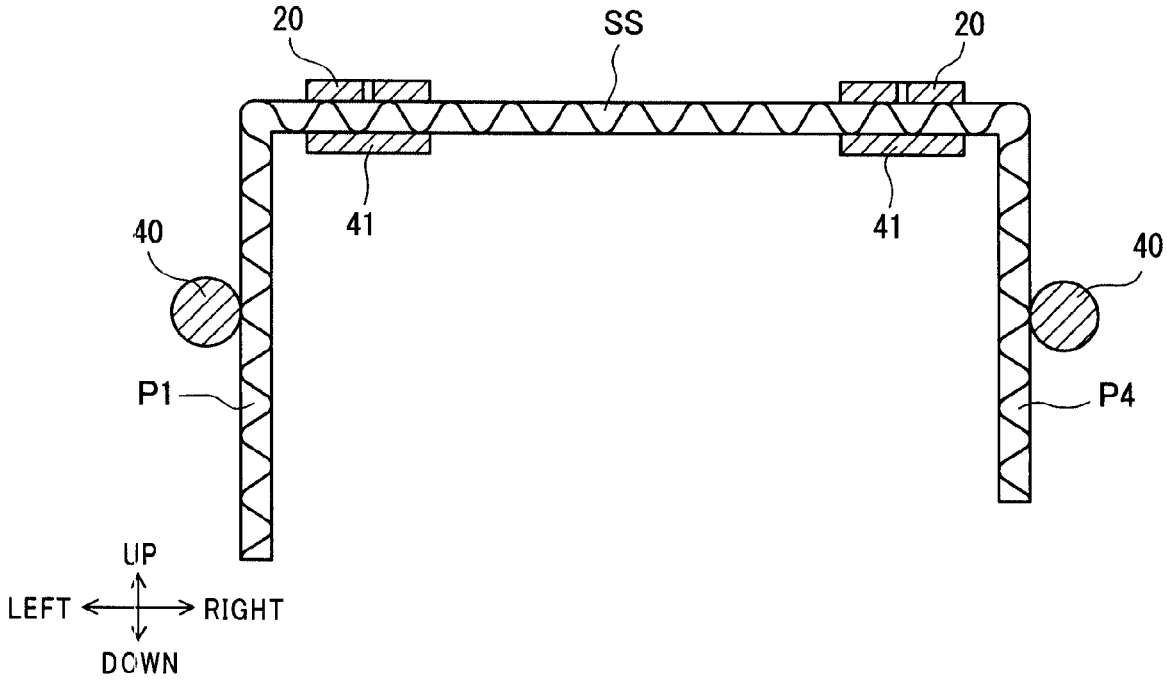
FIG. 15 is a cross-sectional view showing the state in which first and fourth panels P1 and P4 are folded by 90° in a folder gluer according to a first embodiment of the present invention.

First, a gluer 3 coats the gluing tab GS on the fed cardboard sheet SS with glue. The pair of panel folding bars 40 then fold the fed cardboard sheet SS first and fourth panels P1 and P4 from a flat state to 90°. FIG. 15 shows both panels P1 and P4 folded to 90°. This 90° folded state is the state in which a crease begins to form on the inside of the connecting portion of the two panels P1 and P4.

When feed of the cardboard sheet SS is started by the drive force of the feed motor 21, pressing control is executed in accordance with the pressing control program shown in FIG. 12 (S9). Execution of the pressing control program described below results in pressing of the first and fourth panel P1 and P4 connecting portion by the pair of pressing rolls 220L and 220R, and the crease formation direction in the two connecting portions is corrected.

In step S9, after the pressing control operation has been executed for a single cardboard sheet SS a judgment is made as to whether or not the order is complete (S10). A judgment is made as to whether the order is complete based on whether the number of folded cardboard sheets has reached the predetermined number of sheets for processing in the order being implemented. Information indicating the predetermined processing volume is stored in RAM1220 in step S2. If a judgment is made that the order is not complete (S10: No), the pressing control operation is repeated (S9) for the next cardboard sheet SS. If a judgment is made that the order is complete (S10: Yes), processing returns to step S2. Execution of steps S2-S10 is thus repeated and the next order is executed.

Control Performed by Pressing Control Program

Next, operations based on the pressing control program will be discussed in detail, referring to FIG. 12. Initialization is executed (S20) when the pressing control program is started. Initialization consists of resetting the internal measurement counter of the folder gluer control device 1200.

A judgment is made as to whether the front edge detector 42 has detected the passage of the front edge portion FE of the cardboard sheet SS (S21). If a judgment is made that passage of the front edge portion FE has not been detected (S21: No), the step S21 detection judgment is repeated. During the period that this detection judgment is being repeated, the internal measurement counter is adding detection pulse signals issued by the feed amount detector 22 as the cardboard sheet SS is fed.

Figure 16:
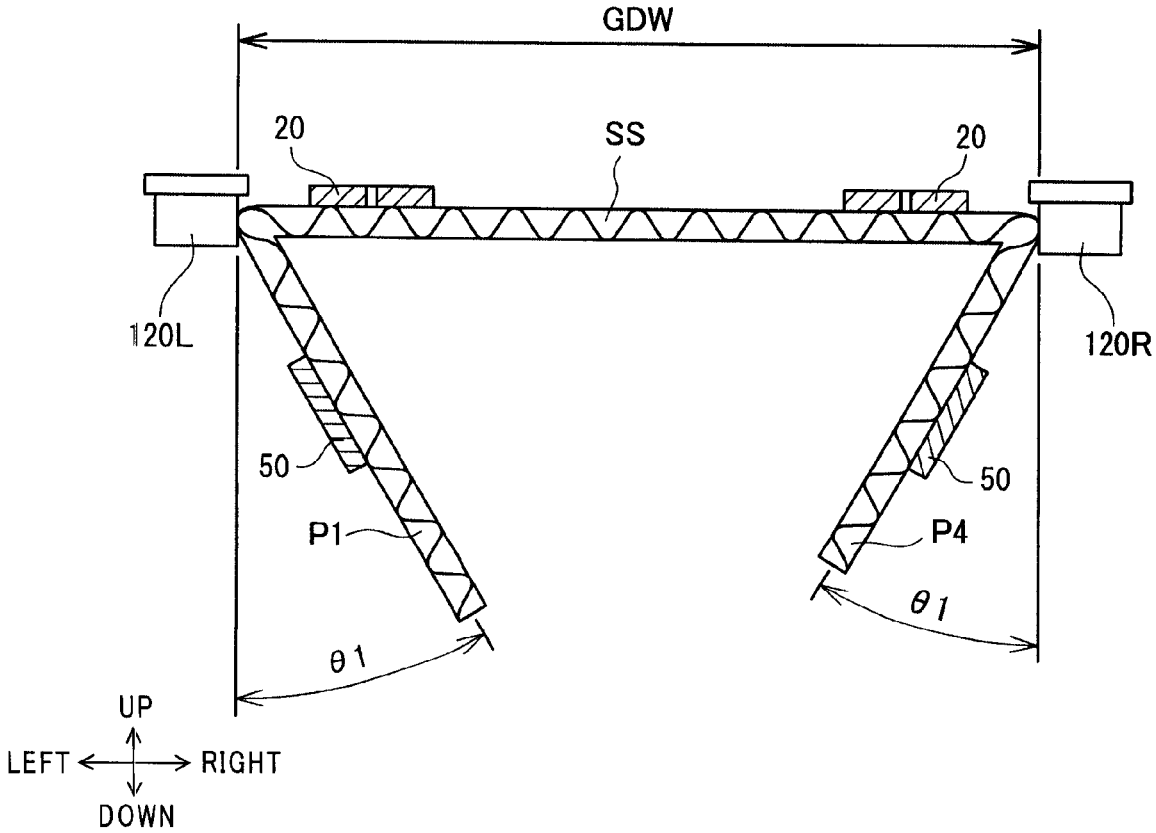
FIG. 16 is a cross-sectional view showing the state in which the connecting portions of the first and fourth panels P1 and P4 are guided and limited by gauge rolls 120L and 120R, and both panels are folded by an angle θ1 from a 90° folded state in a folder gluer according to a first embodiment of the present invention.

If the judgment is made that passage of the front edge portion FE has been detected (S21: Yes), a judgment will be made as to whether the content of the internal measurement counter has reached the feed amount for approach timing CLL stored in the RAM1220 (S22). If a judgment is made that the content of the internal measurement counter has not reached the feed amount for approach timing CLL (S22: No), the feed amount judgment in step S22 is repeated. During the period that the feed amount judgment of step S22 is being repeated, the cardboard sheet SS panel connecting portion is fed, guided, and limited between the pair of gauge rolls 120L and 120R in the predetermined guide distance GDW. As shown in FIG. 16, when the cardboard sheet SS panel connecting portion passes the gauge rolls 120L and 120R disposed on the furthest downstream side, the first and fourth panels P1 and P4 are greatly folded until the angle θ1 reaches approximately 40°. For this reason, the folding angle differs greatly between the downstream portion and the upstream portion of the panel connecting portion, leading to the phenomenon whereby the panel connecting portion gradually spreads toward the upstream direction, splaying outward. The folding state at the point when the panel connecting portion passes the gauge rolls 120L and 120R disposed on the furthest downstream side is a state in which the crease formation direction is gradually determined in the connecting portion, but since the elasticity of the connecting portion sheet is itself still large, the folding state may not be retained at angle θ1 when the folding pressure from the panel folding belt 50 is removed.

Figure 17:
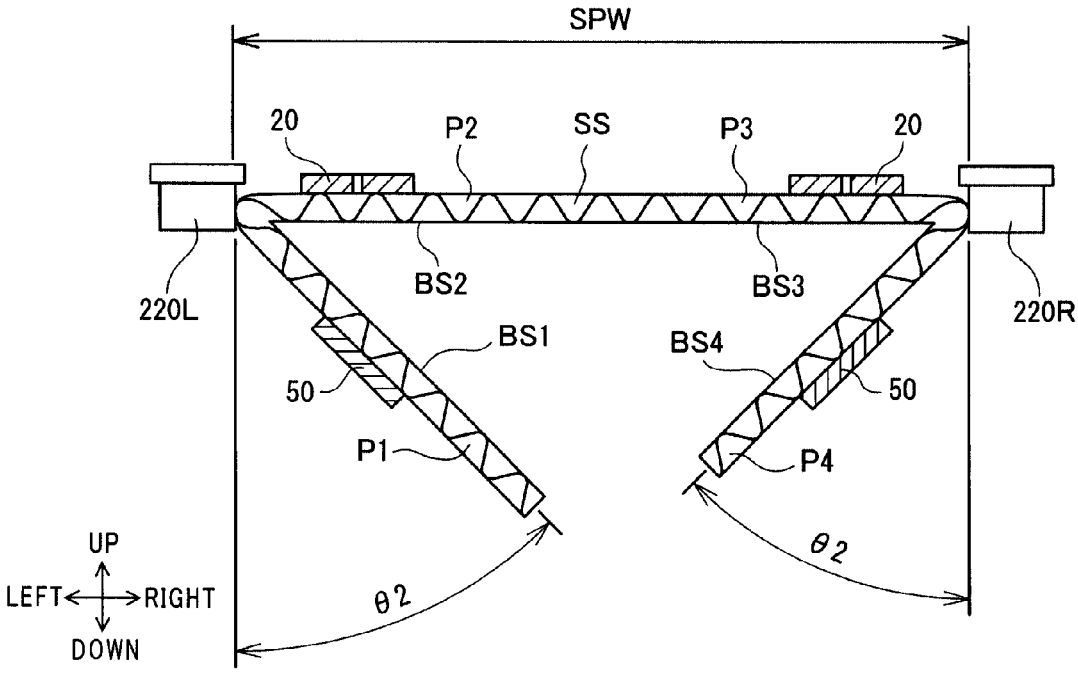
FIG. 17 is a cross-sectional view showing the state in which the connecting portions of the first and fourth panels P1 and P4 in a folder gluer according to a first embodiment of the present invention are fed between separated pressing rolls 220L and 220R, and both panels are folded by an angle θ2 from a 90° folded state.

During the period that the step S22 feed amount judgment is being repeated, the cardboard sheet SS panel connecting portion is further fed, and is fed between the pair of pressing rolls 220L and 220R, which are separated. In a panel connecting portion in the folded state shown in FIG. 17, the surfaces BS1 and BS4 on the inside of both panels P1 and P4 have approached the surfaces BS2 and BS3 on the inside of the second and third panels P2 and P3 to the point of near contact. This state, whereby the inside surfaces of the panels are in proximity, is the state immediately prior to the start of buckling of the corrugation of the corrugated medium in the connecting portion. So long as buckling of the corrugation of the corrugated medium has not yet begun, the crease formation direction is still not established. When buckling of the corrugation of the corrugated medium occurs, the undulating shape of the corrugation of the corrugated medium deforms so as to collapse in the sheet width direction WD, thereby crushing. In the present embodiment, when a cardboard sheet SS with an A flute is folded, the folding angle θ2 of the first and fourth panels P1 and P4 shown in FIG. 17 is approximately 45°.

Figure 18:
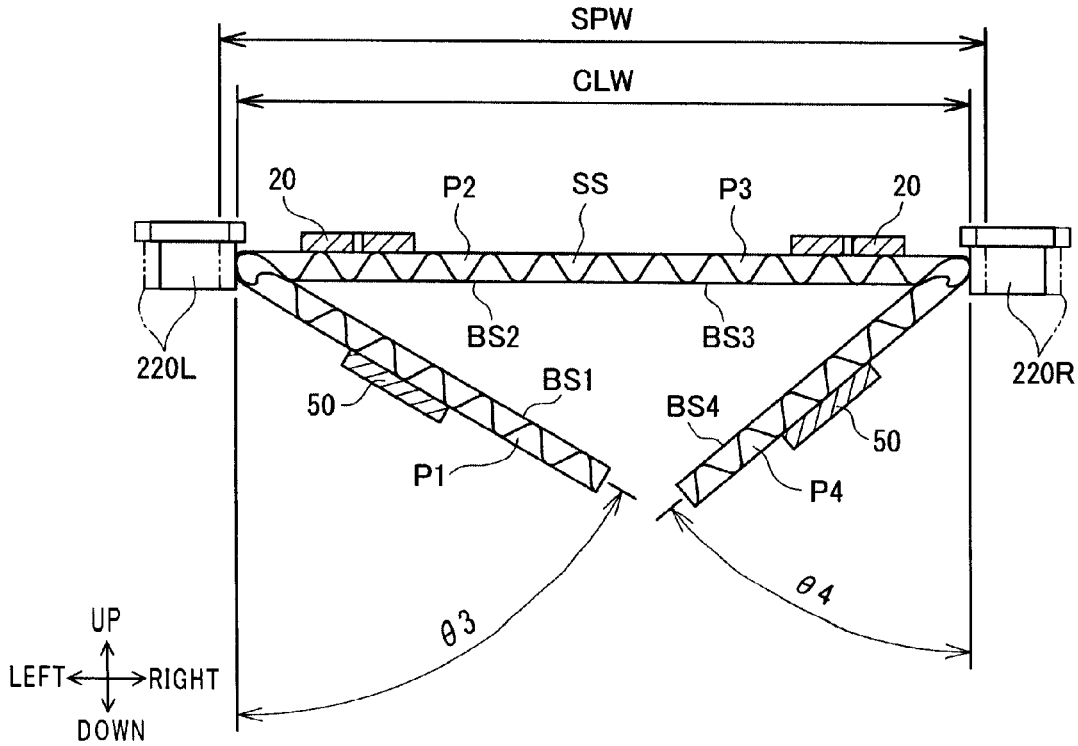
FIG. 18 is a cross-sectional view showing the state in which the joint portions of the first and fourth panels P1 and P4 in a folder gluer according to a first embodiment of the present invention are pressed by proximate pressing rolls 220L and 220R, and the two panels are folded by angles θ3 and θ4 from a 90° folded state.

The cardboard sheet SS is further fed, and the center position of the panel connecting portion reaches the pair of pressing rolls 220L and 220R disposed on the furthest downstream side as shown in FIG. 13. At this point a judgment is made that the contents of the internal measurement counter have reached the feed amount for approach timing CLL (S22: Yes), and an ON command activating the electromagnetic valves on air cylinders 263L, 264L, 263R, and 264R is supplied to the roll pressing drive device 1600 (S23). The pair of movable plates 265 and 266 and support plate 230 are moved in the cardboard sheet width direction by the simultaneous activation of each of the cylinders, and the pair of pressing rolls 220L and 220R are brought into mutual proximity, such that the panel connecting portion is pressed. The distance CLW when the pressing rolls 220L and 220R are in a proximate state is smaller than the predetermined separation SPW in the separated state, as shown in FIG. 1. FIG. 18 shows the state in which the pair of pressing rolls 220L and 220R have pushed the panel connecting portion to a center position, and the first and fourth panels P1 and P4 are folded by the pair of panel folding belts 50 from an angle θ2 to angles θ3 and θ4. In the state shown in FIG. 19, whereby the first and fourth panels P1 and P4 have been folded from a flat state to a 180° fold, the end portion of the fourth panel P4 is glued onto the first panel P1 glue tab GS in an overlapped state. For this reason, the angle of the left and right panel folding belts 50 is adjusted so that in the folded state shown in FIG. 18 the first panel P1 angle θ3 is approximately 5° larger than the fourth panel angle θ4. In the folder gluer according to the first embodiment, when an A flute cardboard sheet SS is folded, the folding angle θ3 of the first panel P1 shown in FIG. 18 is approximately 55°, and the fourth panel P4 folding angle θ4 is approximately 50°.

In a panel connecting portion in the folded state shown in FIG. 18, the surfaces BS1 and BS4 on the inside of both panels P1 and P4 are beginning to approach the surfaces BS2 and BS3 on the inside of the second and third panels P2 and P3. This state, whereby the inside surfaces of the panels are in contact, is the state in which buckling of the corrugation of the corrugated medium in the connecting portion has started due to the folding force of the pair of folding belts 50. The state in which the corrugation of the corrugated medium begins to buckle is a state wherein the elasticity of the connecting portion is low and plastic deformation occurs easily, therefore the direction of crease formation in the connecting portion is corrected by pressure on the connecting portion from the pair of pressing rolls 220L and 220R, and the crease formation direction is secure and does not change even after the pressing force is removed.

After the command to turn on electromagnetic valves is issued in step S23, a judgment is made as to whether the content of the internal measurement counter has reached the feed amount required for separation timing SPL stored in the RAM1220 (S24). If the judgment is made that the content of the internal measurement counter has not reached a feed amount required for separation timing SPL (S24: No), this judgment of the feed amount is repeated.

The cardboard sheet SS is further fed, and the rear end portion BE of the cardboard sheet SS reaches the pressing rolls 220L and 220R on the furthest downstream side. At this point, a judgment is made that the content of the internal measurement counter has reached the feed amount required for separation timing (S24: Yes), and an off command deactivating the electromagnetic valves on air cylinders 263L, 264L, 263R, and 264R is supplied to the roll pressing drive device 1600 (S25). By deactivating each of the air cylinders at the same time, the pair of movable plates 265 and 266 and the support plate 230 are moved in the sheet width direction, and are moved in a direction whereby the pair of pressing rolls 220L and 220R separate from one another, thus ending the panel connecting portion pressing operation.

After the command to turn off the electromagnetic valves is issued in step S25, the pressing control program ends and control processing returns to the main control program shown in FIG. 11; step S10 is then executed. The step S9 pressing control is executed for each cardboard sheet SS of the predetermined order. After the back edge portion BE of the cardboard sheets SS has passed the furthest downstream pair of pressing rolls 220L and 220R, the first and fourth panels P1 and P4 are further folded by the pair of panel folding belts 50, and are folded to 180° as shown in FIG. 19 before reaching the folder gluer 1 discharge port. As shown in FIG. 13, in a folder gluer according to the first embodiment, starting from the time the cardboard sheet SS panel connecting portion passes the furthest upstream pressing rolls 220L-U and 220R-U, and before it passes the furthest downstream pressing rolls 220L-D and 220R-D, the first and fourth panels P1 and P4 are folded from a 90° folding state to a folding angle of approximately 45° to 50°. Furthermore, in the folder gluer according to the first embodiment, if an A flute cardboard sheet SS is in a folded state, then when the center position is pressed by the furthest downstream side pressing rolls 220L-D and 220R-D, the folding angle of the first and fourth panels P1 and P4 on the front edge side of the connecting portion will have an angle folded from the 90° fold state to approximately 70°—in other words it is not folded from a 90° folded state to 90°, or from the flat state to 180°. The direction of crease formation on the front bench side of the panel connecting portion slopes toward the downstream side so as to become narrower, but if the folding angle of the two panels P1 and P4 on the front edge side of this connecting portion is too large, it may occur that the direction of crease formation is not corrected on the front edge side of the connecting portion even if the center position of the connecting portion is pressed.

Control During Order Change

The high level management device 1000 stores processing management plans relating to numerous predetermined orders. When a predetermined order in this processing management plan is executed using an A flute cardboard sheet SS, information relating to a predetermined separation distance SPW for the A flute and information relating to a predetermined guide distance GDW are supplied from the low level management device 1100 as control command information to the folder gluer control device 1200 and stored in the RAM1220. In the present embodiment, the predetermined separation distance STW for an A flute is determined ahead of time to be the same distance as the predetermined guide distance GDW, and to be the same as the predetermined folding width interval W180, which is the interval for both connecting portions when the first and fourth panels P1 and P4 are folded to 180°.

For an A flute, driving of the drive motors 111L and 111R is controlled so that the interval between the pair of gauge rolls 120L and 120R will be the predetermined guide distance GDW. Driving of the drive motors 211L and 211R is controlled so that the distance between the pair of pressing rolls 220L and 220R will be the predetermined separation distance SPW. When a pressing operation is executed with respect to an A flute cardboard sheet SS, the amount of pressing movement from actual pressing of the connecting portion by both pressing rolls 220L and 220R is 2 mm, which is approximately ¼ of one flute pitch of the corrugated medium. This actually pressed amount is the same 2 mm pressing stroke set by the mechanical structure. As a result, the distance CLW when the two pressing rolls are in proximity is 4 mm smaller than the predetermined folding width distance W18, and this 4 mm becomes the total left and right pressing amount.

When an order changes and there is a change in the cardboard sheet from an A flute to a B flute, information about the predetermined separation distance SPW for the B flute and information about the predetermined guide distance GDW is supplied as control command information from the low level management device 1100 to the folder gluer control device 1200, and is stored in the RAM1220. For ease of explanation, in the folder gluer of the first embodiment, the predetermined guide distance GDW is preset at the predetermined folding width interval W180 with the first and fourth panels P1 and P4 folded to 180° for the B flute as well.

For a B flute, driving of the drive motors 111L and 111R is controlled so that the distances of both the gauge rolls 120L and 120R will be the predetermined guide distance GDW. Driving of the drive motors 211L and 211R is controlled so that the distance between the pair of pressing rolls 220L and 220R will be the predetermined separation distance SPW. When a pressing operation is executed with respect to a B flute cardboard sheet SS, the amount of pressing movement from actual pressing of the connecting portion by each pressing roll should be smaller than the 2 mm pressing stroke of each pressing roll, and should be 1.5 mm, which is ¼ of one flute pitch of the corrugated medium of the B flute. For this reason, the predetermined separation distance SPW for the B flute is set to be 1 mm larger than the predetermined separation distance SPW for the A flute. As a result, each pressing roll approaches by the 2 mm pressing stroke amount, but the distance CLW when both pressing rolls are proximate is 3 mm smaller than the predetermined folding width interval W180, and this 3 mm becomes the left and right total pressing amount.

In the folder gluer according to the first embodiment, the constitution comprising a RAM1224 storing information relating to a predetermined separation SPW in accordance with flute type, and the folder gluer control device 1200 for setting the distance when the pair of pressing rolls 220L and 220R are separated, corresponds to the distance changing portion of the present invention. In the folder gluer according to the first embodiment, the folder gluer control device 1200 which executes steps S5, S6, and S20-S25 corresponds to the controller of the present invention.

Second Embodiment

Next, a folder gluer according to a second embodiment of the present invention will be discussed, referring to FIGS. 20 and 21. The second embodiment folder gluer performs gluing while folding a double flap cardboard sheet. In the folder gluer of the second embodiment, the timing at which the pair of pressing rolls 220L and 220R approach and separate differs from the folder gluer of the first embodiment. In the folder gluer of the second embodiment, those portions which are the same as the first embodiment are assigned same reference numerals.

Figure 20:
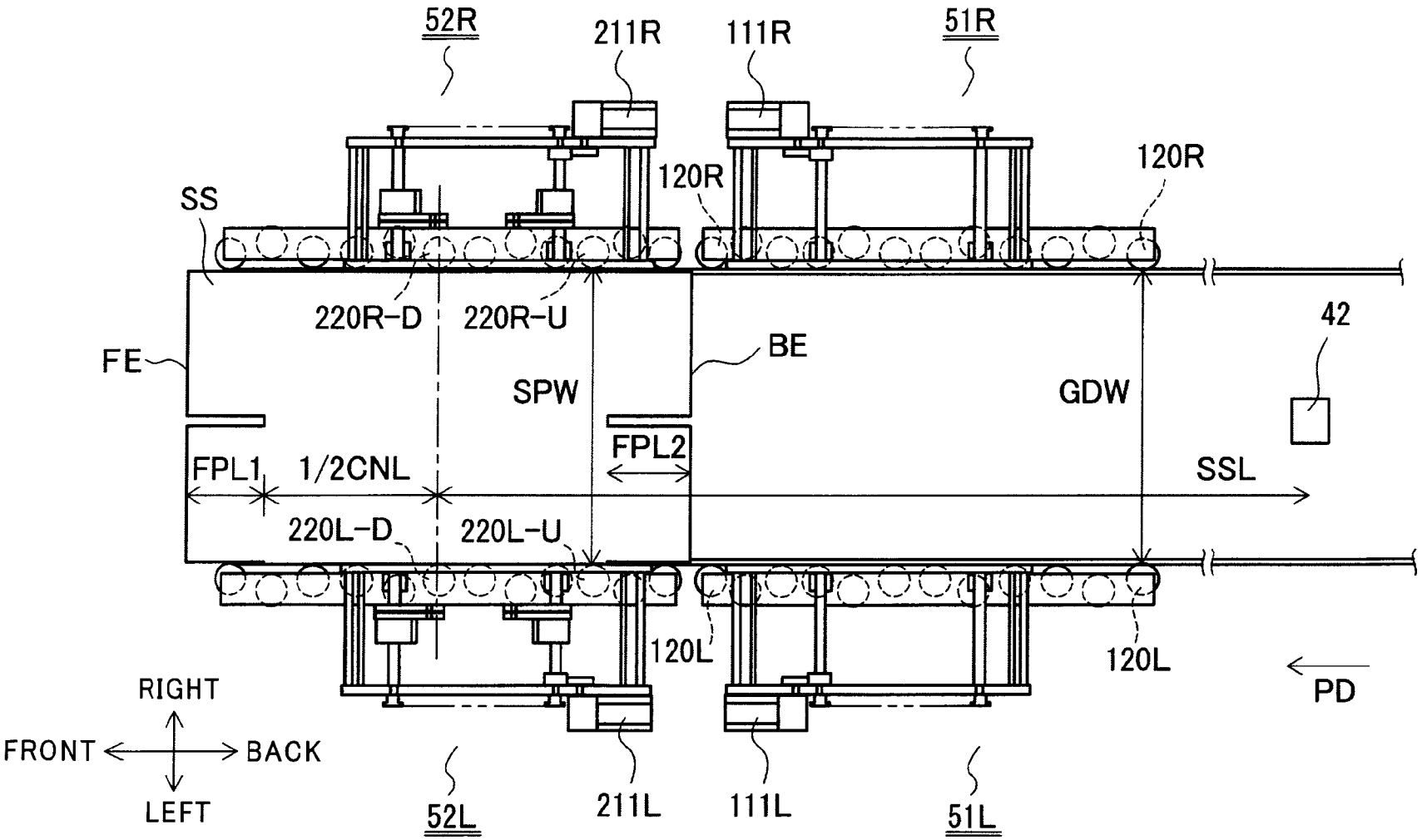
FIG. 20 is a plan view showing the state in which a double flap cardboard sheet SS in a folder gluer according to a first embodiment of the present invention is fed in the feed direction PD, and the center position of the panel connecting portion has reached the position at which the furthest downstream pressing rolls 220L-D and 220R-D are disposed.

As shown in FIG. 20, a double flap cardboard sheet SS has slots formed in its front edge portion FE and back edge portion BE, and has a front edge side flap and a back edge side flap, as well as a panel connecting portion on which no slot is formed. The front edge side flap and the back edge side flap have a predetermined front edge flap dimension FPL1 and back gauge flat dimension FPL2 in a direction parallel to the direction of feed PD, and the panel connecting portion has a predetermined depth dimension CNL.

After the front edge detector 42 detects the front edge FE of the cardboard sheet SS and before the center position of the panel connecting portion reaches the position of the pressing rolls 220L and 220R disposed furthest downstream, and the pressing operation by the two pressing rolls 220L and 220R begins, the cardboard sheet SS must be fed by the feed amount required for the predetermined approach timing CLL. The predetermined approach timing feed amount CLL is calculated in step S5 of the main control program, and that calculation result is stored in the RAM1220. The predetermined approach timing feed amount CLL is calculated by summing the predetermined distance SSL up to the position at which the pressing rolls 220L and 220R are disposed furthest upstream from the position at which the front edge detector 42 is disposed, as shown in FIG. 20, plus ½ the value of the predetermined depth dimension CNL and the predetermined flap dimension FPL1, then subtracting a value from that total corresponding to the air cylinder 263 and 264 electromagnetic valve turn on delay time.

Figure 21:
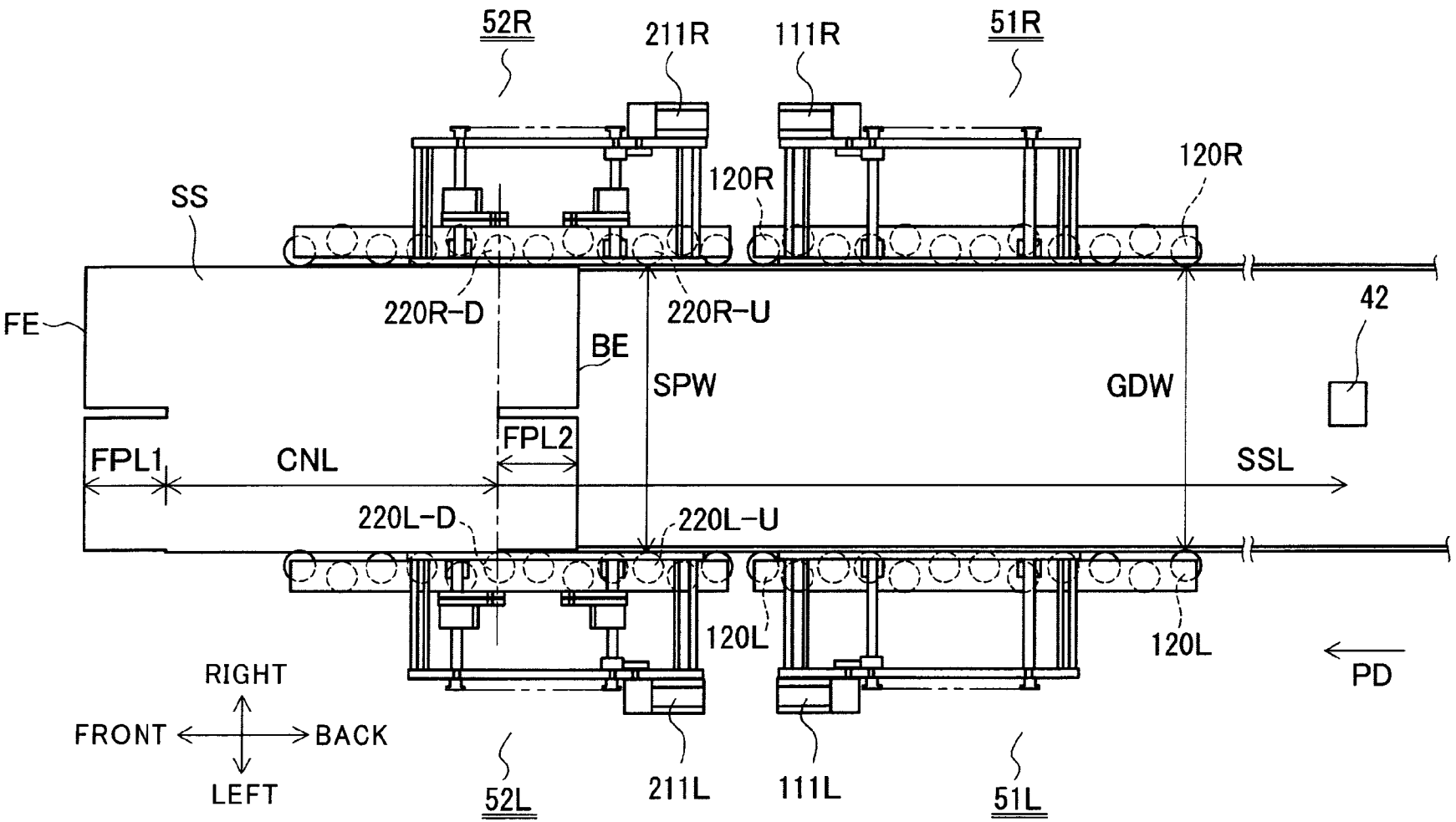
FIG. 21 is a plan view showing the state in which the terminus of the panel connecting portion in a folder gluer according to a first embodiment of the present invention passes by the furthest downstream pressing rolls 220L-D and 220R-D.

After the front edge detector 42 detects the front edge FE of the cardboard sheet SS, the cardboard sheet SS, as shown in FIG. 21, must be fed by a predetermined separation timing feed amount SPL before the cardboard sheet SS back edge BE passes the position at which the furthest downstream pressing rolls 220L and 220R are disposed. This predetermined separation timing feed amount SPL is calculated in step S6 of the main control program, and that calculation result is stored in the RAM1220. The predetermined separation timing feed amount SPL is calculated by summing the predetermined distance SSL shown in FIG. 21, the predetermined depth dimension CNL, and the predetermined front edge flap dimension FPL1, then subtracting from that total a value corresponding to the air cylinder 263 and 264 electromagnetic valve turn-off operation delay time.

In the folder gluer according to the first embodiment, because a single flap cardboard sheet SS does not have a flap on the back edge side, the separation timing feed amount SPL is calculated without considering the air cylinder turn-off operation delay time. However, in the folder gluer of the second embodiment, the double flap cardboard sheet SS does have a flap on the back edge side, therefore in order to prevent this back edge side flap from being crushed by the pushing operation of the pressing rolls 220L and 220R, the separation timing feed amount SPL is calculated with a consideration for the air cylinder turn-off operation delay time.

Control processing for the second embodiment folder gluer other than steps S5 and S6 of the main control program is the same as the first embodiment, so an explanation thereof is here omitted.

Modifications

1. In the embodiments of the present invention described above, information about the predetermined guide distance GDW, the predetermined separation distance SPW, and the predetermined folding width interval W180 was pre-stored for each order in a processing management plan, and was supplied from a low level management device 1100 to a folder gluer control device 1200 and stored in a RAM1220. In lieu of this, however, a user could input information relative to the predetermined guide distance GDW, the predetermined separation distance SPW, and the predetermined folding width interval W180 from an information input control panel on the folder gluer control device 1200 and cause it to be stored in the RAM1220.
2. In the embodiments of the present invention described above, the pressing stroke movement is fixed when the pair of pressing rolls 220L and 220R are in a proximate state, and the predetermined separation distance SPW when the two pressing rolls are separated is set according to the type of flute, so that the actual amount by which the pressing rolls press the connecting portion in the sheet width direction WD is changed according to the flute pitch of the corrugated medium of the cardboard sheet SS. In lieu of this, however, the pressing stroke itself could be automatically changed by using a motor to drive the rotation of stopper bolts 267 and 268 and changing the amount by which these stopper bolts are screwed into retaining plates 261 and 262.
3. In the embodiments of the present invention described above, the diameter of the pressing rolls 220L and 220R was set to be larger than the diameter of the gauge rolls 120L and 120R. Setting the diameter of the pressing rolls to be relatively large enabled the pressing rolls to contact the panel connecting portion over a relatively large area, so that pressing force was not concentrated locally and there was no abnormal the formation of the panel connecting portion, or damage thereto. In lieu of this, however, the diameter of the pressing rolls could also be set to be the same or smaller than the diameter of the gauge rolls. In that case, the pressing force could be set low so that stress did not concentrate locally, and the timing of the separation of the pressing rolls could be controlled so that the pressing roll pressing operation is continued during the interval in which the panel connecting portion is being fed in the feed direction by the distance between two adjacent pressing rolls.
4. In the embodiments of the present invention described above, air cylinders 263 and 264 are used to impart a pressing force to the pair of pressing rolls 220L and 220R. In lieu of air cylinders, however, other pressing devices such as electromagnetic solenoids could also be used. In such cases, when the panel connecting portion is pushed at a high speed, it may occur that the second and third panels P2 and P3 of the cardboard sheet SS shown in FIG. 18 distort in the vertical direction such that the connecting portion cannot be sufficiently pushed in the sheet width direction WD. For this reason, it is necessary that the speed at which other pressing devices press be sufficiently fast that there is no vertical deformation of the second and third panels.
5. In the embodiments of the present invention described above, the left-right total pressing amount by which the pair of pressing rolls 220L and 220R actually press the panel connecting portion is set at approximately ½ of one flute pitch of the corrugated medium. Normally when the panel connecting portion is folded, it often occurs that the crease formation direction in the connecting portion skews within the range of one flute pitch of the corrugated medium, including the position at which a crease is formed. The left-right pushing amount can vary with cardboard paper quality and environmental conditions such as humidity and the like if the left-right total pressing amount is equal to or smaller than one flute pitch of the corrugated medium. For example, if the paper quality is a high-quality pulp or the like with good elasticity, then the left-right total pressing amount may be set equal to or larger than ½ of one flute pitch of the corrugated medium. If there are multiple stacked corrugation layers and the flute pitch of the corrugated medium in each layer is different, the left-right total pushing amount is determined based on the flute pitch of the corrugated medium having a largest flute pitch.

6. In the embodiments of the present invention described above, when an A flute cardboard sheet SS is used, the first panel P1 folding angle θ3 shown in FIG. 18 changes from an approximately 90° folded state to approximately 55° when the center position of the panel connecting portion is pressed by the pressing rolls 220L and 220R on the furthest downstream side. However, the position pressed on the connecting portion by the furthest downstream pressing rolls is not limited to being the center position on the connecting portion, and can change depending on the cardboard sheet SS predetermined depth dimension CNL. For example, if the predetermined depth dimension CNL lengthens, the pressing position of the connecting portion pressed by the two furthest downstream pressing rolls is changed from the center portion thereof to a position on the front edge side. Also, there is no limitation that the folding angle θ3 be approximately 55° and the folding angle θ4 be approximately 50°; these can vary according to various factors such as the type of flute, the paper quality, the width dimensions in the first and fourth panel sheet width direction WD, environmental conditions, and the like within a range of greater than 0° and less than 90° in a 90° folded state—in other words, within a range of angles greater than 90° and less than 180° from the flattened state of the cardboard sheet SS. For example, when humidity is high there is a tendency for folding angles θ3 and θ4 to increase. On the other hand, in sheets with high paper fiber density, or in sheets with a large width dimension in the first and fourth panel sheet width direction WD, there is a tendency for folding angles θ3 and θ4 to increase. As shown in FIG. 18, the folding angles θ3 and θ4 when the panel P1 and P4 inside surfaces BS1 and BS4 begin to make contact with the panel P2 and P3 inside surfaces BS2 and BS3 generally fall within a range of 45° to 60°.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A folder gluer for folding a cardboard sheet having first through fourth panels connected through connecting portions and a glue tab and joining the first and fourth panels at the glue tab, said folder gluer comprising:

a feed device for feeding a cardboard sheet in a cardboard sheet feed direction;

a pair of folding members for gradually folding the respective first and fourth panels from 0° to 180° when the cardboard sheet is being fed in the cardboard feed direction;

a pair of pressing members movable relative to one another in a cardboard sheet width direction perpendicular to the cardboard sheet feed direction, the pressing members being positioned to press the connecting portions of the first and fourth panels when the pressing members are in a state before the start of buckling and crease formation of the connecting portions of the first and forth panels are established;

a detector disposed upstream in the feed direction from the pair of pressing members for detecting a passage of the cardboard sheet being fed in the feed direction and generating a detection signal; and a controller for determining, based on the generation of the detection signal from the detector, a timing at which the pair of pressing members are caused to move relative to one another and press on the connection portions of the first and fourth panels after the first and fourth panels are folded to 90° and before being folded to 180°, wherein the pair of pressing members approach one another and separate from one another in the cardboard sheet width direction to press the connecting portions of the first and fourth panels; and a distance between the pair of pressing members when the pair of pressing members approach one another is set to be smaller than a predetermined folding width interval in the cardboard sheet width direction between the first panel connecting portion and the fourth panel connecting portion when the first and fourth panels are in a 180° folded state; and wherein the controller determines a timing at which the pair of pressing members approach one another and a timing at which the pair of pressing members separate from one another, and holds the pressing members in a proximate state during the period from the approach timing to the separation timing; and the controller determines, as the approach timing, based on the generation of the detection signal from the detector, and determines the separation timing according to the length of the area in the feed direction of the connecting portion being pressed, the timing for causing the pair of pressing members to approach one another and press the first and fourth panel connecting portions, after the first and fourth panels are folded by 90° and before being folded by 180°.

2. The folder gluer according to claim 1, wherein the difference between the pair of pressing members in the proximate state is equal to or larger than ½ of one flute pitch and equal to or smaller than one flute pitch of a corrugated medium of the cardboard sheet being folded.

3. The folder gluer according to claim 1, wherein the folder gluer further comprises a distance changing device for changing the distance between the pair of pressing members in the proximate state in accordance with a cardboard sheet flute type.

4. The folder gluer according to claim 1, wherein the controller determines, based on the generation of the detection signal from the detector, the timing for causing the pair of pressing members to move relative to one another and press the connecting portions of the first and fourth panels, when the first and fourth panels of the cardboard sheet creased on one surface are folded at the connecting portions, and after being folded to the state in which the first and fourth panels respectively begin to make contact with the second and third panels on the one surface of the connecting portions, but before being folded 180°.

5. The folder gluer according to claim 1, wherein the cardboard sheet comprises slot forming portions at one end only for forming slots extending in a direction parallel to the feed direction, and connecting portions from the terminuses of the slots to the other end of the cardboard sheet; and the controller determines the separation timing in accordance with the predetermined connecting portion dimension in the feed direction from the terminus of the slots to the other end of the cardboard sheet.

* * * * *